US006502722B1

(12) United States Patent
Shimizu et al.

(10) Patent No.: US 6,502,722 B1
(45) Date of Patent: Jan. 7, 2003

(54) SYNTHETIC RESIN TUBE CONTAINER

(75) Inventors: Masaru Shimizu, Fujioka (JP); Tatsuhara Ida, Fujioka (JP); Takao Kishi, Tokyo (JP); Shigeo Iizuka, Tokyo (JP); Kazuaki Nose, Tokyo (JP); Yoshiyuki Kakuta, Tokyo (JP); Takayuki Goto, Tokyo (JP); Hiroyuki Nakamura, Tokyo (JP); Haruo Tsuchida, Tokyo (JP); Katsuhito Kuwahara, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 09/720,973

(22) PCT Filed: Jun. 30, 2000

(86) PCT No.: PCT/JP00/04370

§ 371 (c)(1),
(2), (4) Date: Mar. 5, 2001

(87) PCT Pub. No.: WO01/02262

PCT Pub. Date: Jan. 11, 2001

(30) Foreign Application Priority Data

| | | |
|---|---|---|
| Jun. 30, 1999 | (JP) | 11-185529 |
| Jun. 30, 1999 | (JP) | 11-185811 |
| Sep. 24, 1999 | (JP) | 11-271160 |
| Sep. 24, 1999 | (JP) | 11-271161 |
| Dec. 28, 1999 | (JP) | 11-372215 |
| May 30, 2000 | (JP) | 2000-160547 |

(51) Int. Cl.[7] ..... B65D 35/00

(52) U.S. Cl. ..... 222/107; 222/153.07; 222/556

(58) Field of Search ..... 222/92, 107, 153.06, 222/153.07, 546, 556

(56) References Cited

U.S. PATENT DOCUMENTS

| | | | | | |
|---|---|---|---|---|---|
| 4,984,716 | A | * | 1/1991 | Beck | 222/153 |
| 5,058,775 | A | * | 10/1991 | Gross et al. | 222/153 |
| 5,213,235 | A | * | 5/1993 | Miranda | 222/107 |
| 5,785,209 | A | * | 7/1998 | Guglielmini | 222/153.07 |
| 5,810,207 | A | * | 9/1998 | Hayashida | 222/153.07 |
| 5,979,706 | A | * | 11/1999 | Grussmark | 222/93 |
| 6,170,710 | B1 | * | 1/2001 | Suffa | 222/153.06 |
| 6,260,723 | B1 | * | 7/2001 | Bergholtz | 222/153.06 |

FOREIGN PATENT DOCUMENTS

| | | |
|---|---|---|
| JP | 51-128740 | 10/1976 |
| JP | U 63-67451 | 5/1988 |
| JP | U 2-48563 | 4/1990 |
| JP | U 2-59153 | 4/1990 |
| JP | U 2-79252 | 6/1990 |
| JP | U 2-117362 | 9/1990 |
| JP | U 3-32058 | 3/1991 |
| JP | U 3-38747 | 4/1991 |
| JP | U 3-78754 | 8/1991 |
| JP | U 6-81955 | 11/1994 |
| JP | A 9-295652 | 11/1997 |
| JP | A 9-315448 | 12/1997 |

* cited by examiner

*Primary Examiner*—Joseph A. Kaufman
(74) *Attorney, Agent, or Firm*—Oliff & Berridge, PLC

(57) ABSTRACT

A synthetic resin tube container is formed to have a shortened neck portion and to eliminate an overlapping double wall in a structure for mounting a cap to the neck portion. The tube container comprises a container body and a cover plate. The container body has a trunk portion from which the neck portion is extending upwardly through an inward flanged wall. The upper surface of the neck portion is closed by a top wall with a discharge port. A fitting recessed groove is formed circumferentially on the inward flanged wall. The cover plate is connected via a hinge to an insert cylinder which is fitted into the fitting recessed groove.

10 Claims, 35 Drawing Sheets

SYNTHETIC RESIN TUBE CONTAINER

TECHNICAL FIELDS

Present invention relates to a synthetic resin made tube container.

PRIOR ART

As this type of container, there is widely used a synthetic resin made tube container shown in FIG. 59. This container consists of a container body 101 including a trunk portion 102 with an upper end from which a neck portion 104 is extending upwardly through a shoulder 103; and of a cover body 105 including a top wall 107 closing an upper face of the neck portion 104 and having a discharge cylinder 106, a mounting cylinder 108 which is depending from a lower periphery of the discharge cylinder 106 for providing a screw engagement with the outside of the neck portion, and a cover tube 109 depending from the circumference of the top wall, and a cover plate 110 with an outer edge from which a circumferential wall 111 is depending, said circumferential wall being connected to the top wall 107 via a thin hinge 112.

In this container, however, the mounting cylinder 108 is fitted on the neck portion 104 by screwing thereto. For fitting it firmly, screw threads have to be formed for a certain, sufficient vertical range, so that both of the neck portion and the mounting cylinder, which are overlapping as a double cylinder, are have to be made long, interrupting reduction of the material for manufacturing the container. This not only increases its manufacturing cost but also the amount of waste when the containers are done away with.

Moreover, the above-mentioned container is provided with the top wall from the circumference of which the cover tube is depending for facilitating rotation operation with respect to the neck portion. In this construction, the outer circumferential portion of the top wall and the shoulder are overlapping generally as an upper and lower double wall, so that in this aspect also, the material for forming the container is used in vain.

Although the above mentioned double wall structures are unfavorable in view of economy of the material, however if the construction of the container is just simplified by, for example, removing the screw threads from the neck portion and the mounting cylinder and shortening the length of the double cylinder, the ability of sealing the container is decreased and water may permeate into the container from the outside.

For removing the overlapping of the shoulder and the outer circumferential portion of the top wall, it is possible to omit the cover cylinder and a top wall portion out of the mounting cylinder 108. For example, in a known container shown in FIG. 60, a cover body 105 has a top wall 107 from an outer edge of which a mounting cylinder 108 for fixing on the neck portion is depending. Still more, there is a room for economizing the material for forming this container by separating the top wall 107 and the mounting cylinder 108, and connecting the periphery of the top wall to an inside of the upper end portion of the neck portion. And moreover, if the neck portion and the mounting cylinder are further shortened to economize the material, there arises a problem that an angular portion 114 of the cover plate may strike against the shoulder 103 of the container in an open state depicted with a double-dot chain line in FIG. 60, resulting in a damage to a hinge 112.

Furthermore, as a structure for attaching a cover plate to the neck portion other than the mounting cylinder for screwing thereon, the present applicant proposes a container having a neck portion extending upwardly from a trunk portion, and a top wall closing an upper surface of the neck portion and having a discharge port, a deep groove formed by recessing the rear portion of the top wall, and a thrusting plate which is depending from the back of the cover plate through a hinge mechanism and inserted into the deep groove (Japanese Utility Model Laid Open No. 63-67451). However, there is no idea in this container to economize the material by providing a short neck with a lower head so as to shorten a length from the upper end of the trunk portion to the upper side of the cover plate.

DISCLOSURE OF THE INVENTION

A primary purpose of the present invention is to remove the overlapping double wall structure to economize the material for forming the container. For this purpose, there is proposed a synthetic resin made tube container comprising a container body having a neck portion extending upwardly from a trunk portion through an inward flanged wall on which a fitting recessed groove is circumferentially formed, and a top wall closing the upper surface of the neck portion and having a discharge port; a cap body having a cover plate and an insert cylinder which is connected to the cover plate via a hinge and inserted into the fitting recessed groove.

A secondary purpose of the present invention is to eliminate a structure in which the top wall and the shoulder overlapping in upper and lower sides. For this purpose, the present invention proposes a synthetic resin made tube container having a mounting cylinder fitted into the upper portion of a trunk portion, said mounting cylinder having a lower part from which a neck portion is extending upwardly through an inward flanged wall, such that a fitting recessed groove is formed between the inside of the mounting cylinder and the outside of the neck portion.

A third purpose of the present invention is to provide a synthetic resin made tube container having a sealing function for preventing an unintentional opening. For this purpose, the cover plate of the container is provided at its circumference with a depending cylinder to which an anti-opening plate is attached. Said anti-opening plate is adhered forcibly removably to the outside of the trunk portion.

A fourth purpose of the present invention is to prevent an unauthorized opening of the cover plate. For this purpose, there is provided a synthetic resin made tube container which is sealed by providing a depending cylinder at the circumference thereof with the anti-opening plate which is attached forcibly removably to the outside of the trunk portion. Otherwise, the container may be sealed by providing at the circumference of the cover plate with a depending cylinder having an intermediate portion, a part of which is formed into a hinge, while a remainder thereof being formed into a removable belt.

A fifth purpose of the present invention is to propose a cap body fitting on a neck portion and having a cover plate which is free from striking against a shoulder of the container in opening the cover plate, when the neck portion is shorten in its vertical length for economizing the material for forming it. For this purpose, there is proposed a synthetic resin made tube container having a cap body with an angular portion between the cover plate and a depending cylinder, said angular portion being chamfered to form a slant wall, such that the angular portion does not strike against the shoulder.

A sixth purpose of the present invention is to provide another type of synthetic resin made tube container in which the material for forming it is economized. Said container has a trunk portion with a shoulder from which a short neck portion is extending upwardly, with an upper face of the neck portion being closed by a top wall having a discharge port, and a cover plate having at its rear portion with a flat insert plate which is depending therefrom through a hinge mechanism. Said insert plate is inserted into a deep groove which is formed at a rear end portion of the top wall and extending narrowly into left and right direction.

A seventh purpose of the present invention is to prevent unfavorable rotation of a cover plate. For this purpose, the present invention provides a synthetic resin tube container including a fitting cylinder fixed on the outside of the neck portion, and a cover plate which is mounted through the fitting cylinder, wherein a vertical groove and a vertical ridge for providing mutual engagement are formed on the outside of the neck portion and the inside of the fitting cylinder.

An eighth purpose of the present invention is to provide a synthetic resin tube container in which a length between an upper end of its trunk portion and an upper surface of the cover plate is further shortened. For this purpose, the container includes a neck portion and a fitting cylinder fixed thereon, said fitting cylinder having at its lower part an outwardly extended plate circumferentially formed for resting a depending cylinder thereon, while a part of the depending cylinder is connected to the outwardly extended plate through a hinge.

A ninth purpose of the present invention is to provide a synthetic resin made tube container having one or more of breaking piece or a removable belt between a fitting cylinder and a cover plate.

Other objects of the present invention will be apparent from a later-described Detail Description of the Present Invention.

BEST MODE FOR CARRYING OUT THE INVENTION

Figure 1:
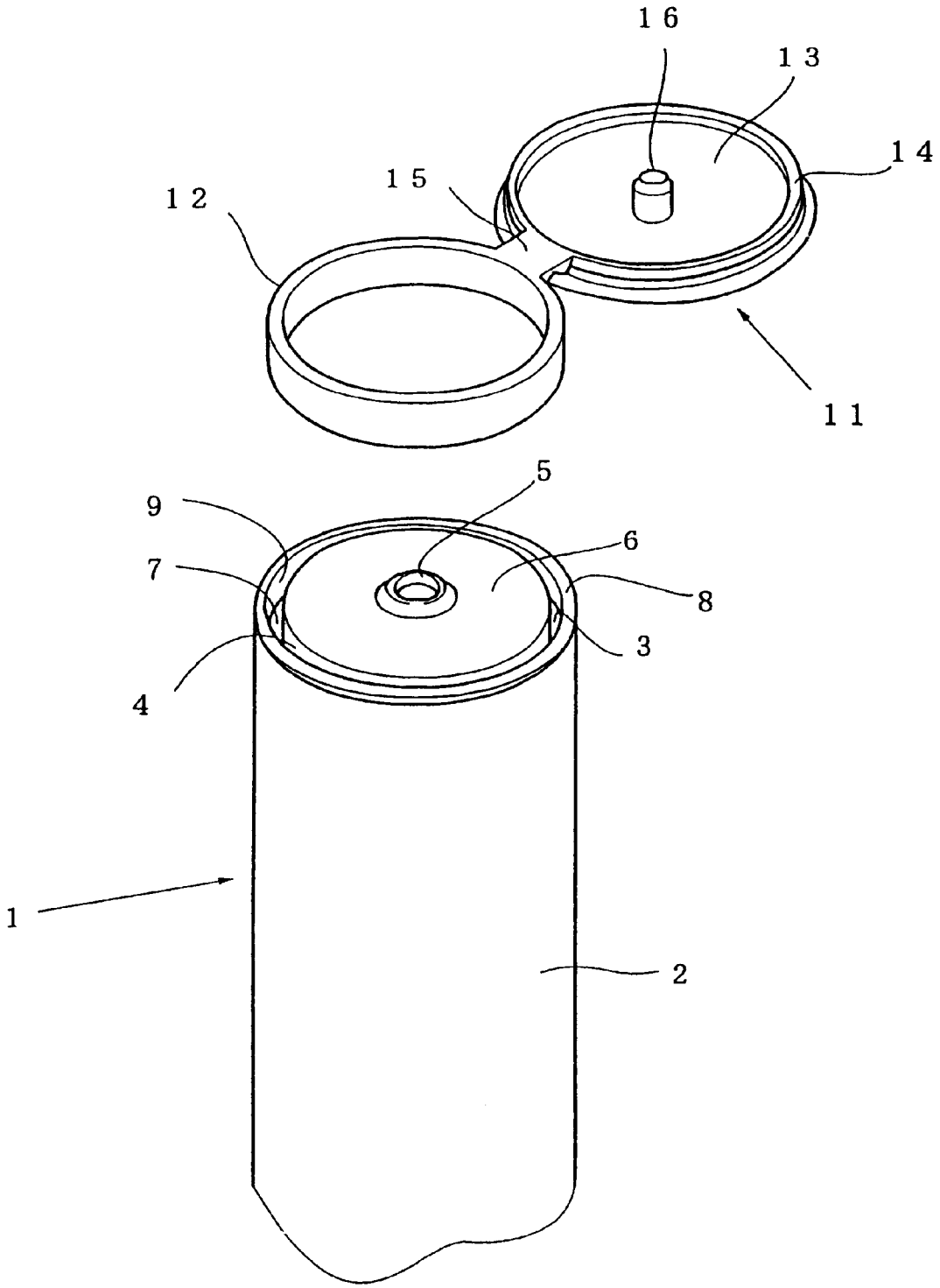
FIG. 1 is a perspective view of the container in a first embodiment of the present invention in a disassembled state.
Figure 2:
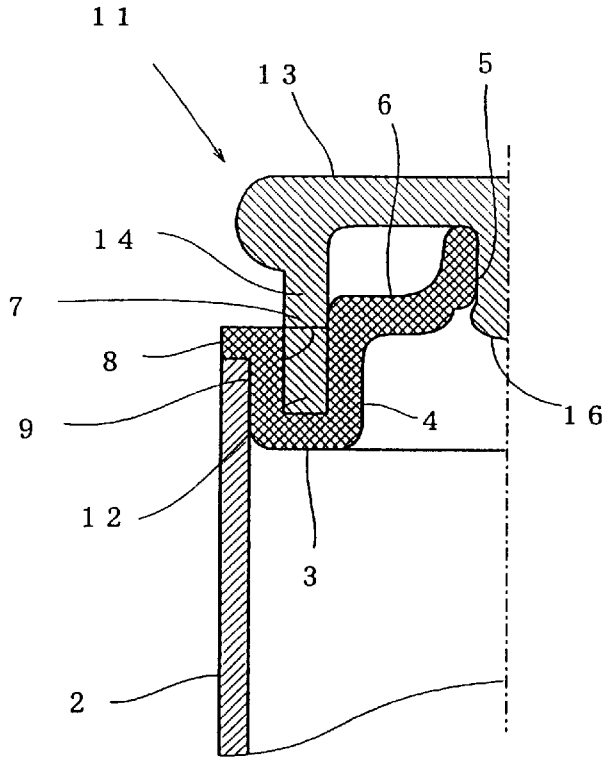
FIG. 2 is a vertical sectional view of an element of the container shown in FIG. 1
Figure 3:
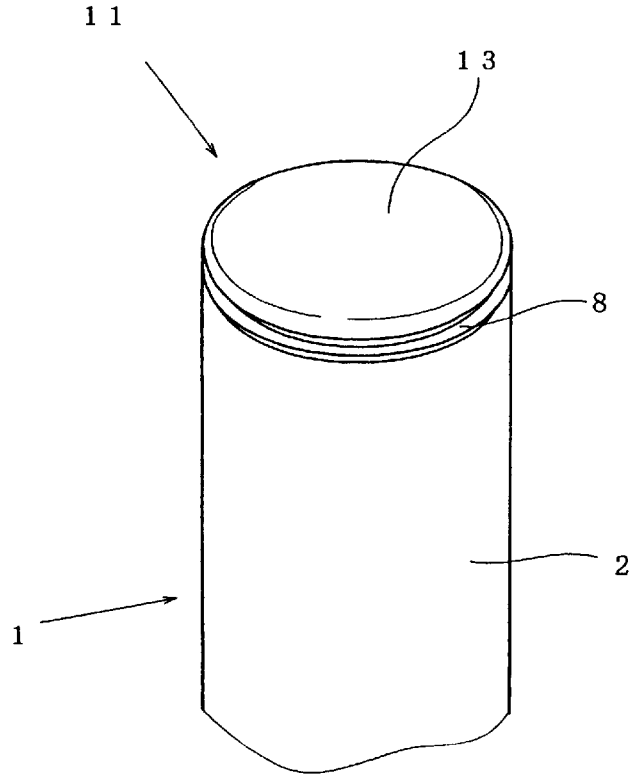
FIG. 3 is a perspective view of the container shown in FIG. 1.

FIGS. 1 to 3 shows a first embodiment of the present invention.

Numeral 1 designates a container body having an elastically squeezable trunk portion 2, from which a wide mouthed neck portion 4 is erecting through an inward flanged wall 3. An upper surface of the neck portion 4 is closed by a top wall 6 with a discharge port 5, and a top opened fitting recessed groove 7 is circumferentially formed on the inward flanged wall 3.

The trunk portion 2 is formed into a cylinder with a top end opened and a lower end closed by heat or supersonic welding.

A short mounting cylinder 9 is fitted water-tightly into the upper end of the trunk portion 2. Said mounting cylinder 9 is depending from an inner edge of an outward flange 8 resting on the upper end of the trunk portion 2, while a lower end of the mounting cylinder 9 is connected to the inward flanged wall 3 having an inner circumference from which the neck portion 4 is extending upwardly. The neck portion 4 and the mounting cylinder 9 are arranged to form inner and outer two cylinders with a small interval there-between, such that the fitting recessed groove 7 is formed between the two cylinders. The shown mounting cylinder 9 and the trunk portion 2 are made as separate members, but they can be formed as an integral member. And also, in the shown embodiment, the neck portion 4 is formed into a short cylinder, a length of which is generally equal to that of the mounting cylinder 9. As the result, the outward flange 8 and the top wall 6 for closing the upper end of the neck portion are positioned at generally the same level, so as to minimizing the height from the upper end of the trunk portion 2 to the upper wide of a later-described cover plate without decreasing the volume of the container.

A discharge cylinder is extending upwardly from the center of the top wall 6, opening the discharge port 5 at its upper end.

Numeral 11 designates a cap body. Said cap body comprises an insert cylinder 12 which has a length generally equal to the depth of the fitting recessed groove 7 and is fitted thereinto, and a cover plate 13 with a circumference from which a depending cylinder 14 is extending downwardly. The depending cylinder is resting on the the upper side of the insert cylinder, and the lower end of the depending cylinder 14 and the upper end of the insert cylinder 12 are connected through a thin hinge 15. A plug 16 for closing the discharge port is depending from the center of the cover plate 13.

Figure 59:
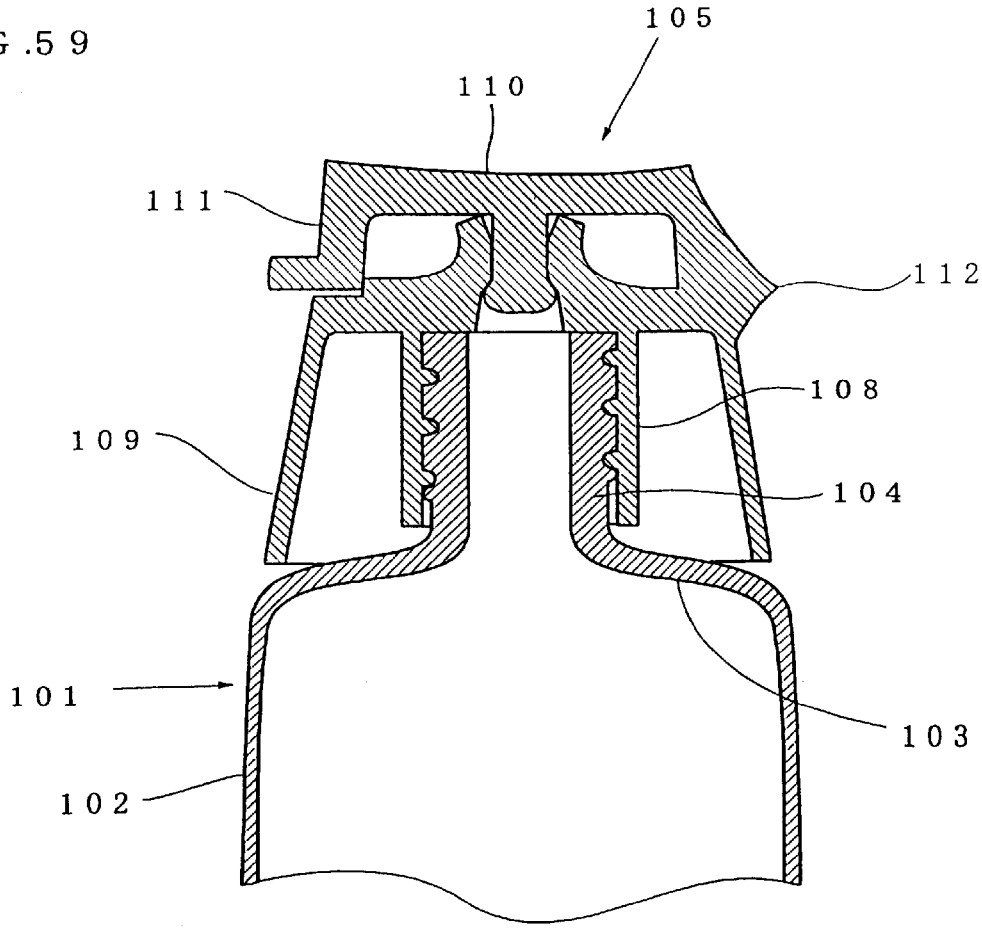
FIG. 59 is a vertical sectional view of a conventional container.

In the above construction, the top wall 6 is merging into the mounting cylinder 9 fitted into the upper end portion of the trunk portion 2, such that the present container does not need a screw mechanism for fixing the neck portion to the mounting cylinder depending from the top wall, as the conventional container in FIG. 59 does. Accordingly, it is not necessary to form the cover cylinder for rotating the mounting cylinder, nor the top wall portion for depending the cover cylinder, such that there is no inconvenience that the top wall portion and the shoulder are overlapping.

The container body 1, the top wall 6, and cap body 11 can be made of synthetic resin.

Figure 4:
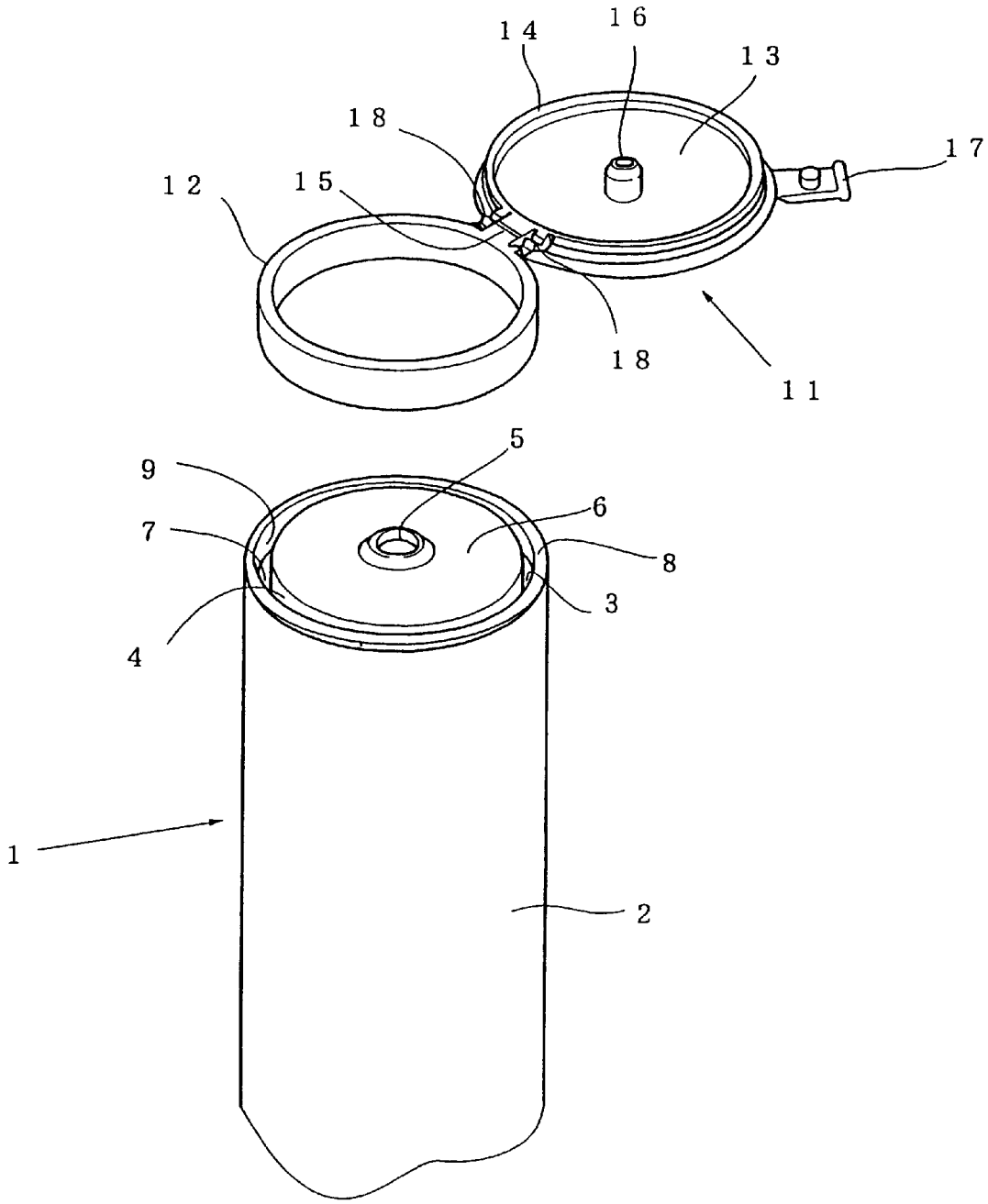
FIG. 4 is a perspective view of the container in a second embodiment in a disassembled state.
Figure 5:
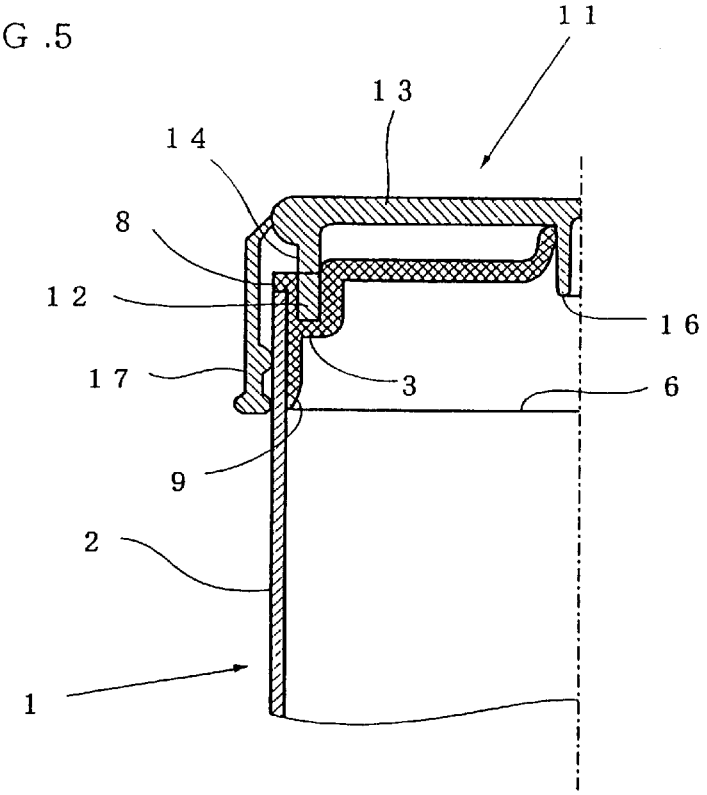
FIG. 5 is a vertical sectional view of an element of the container shown in FIG. 4.
Figure 6:
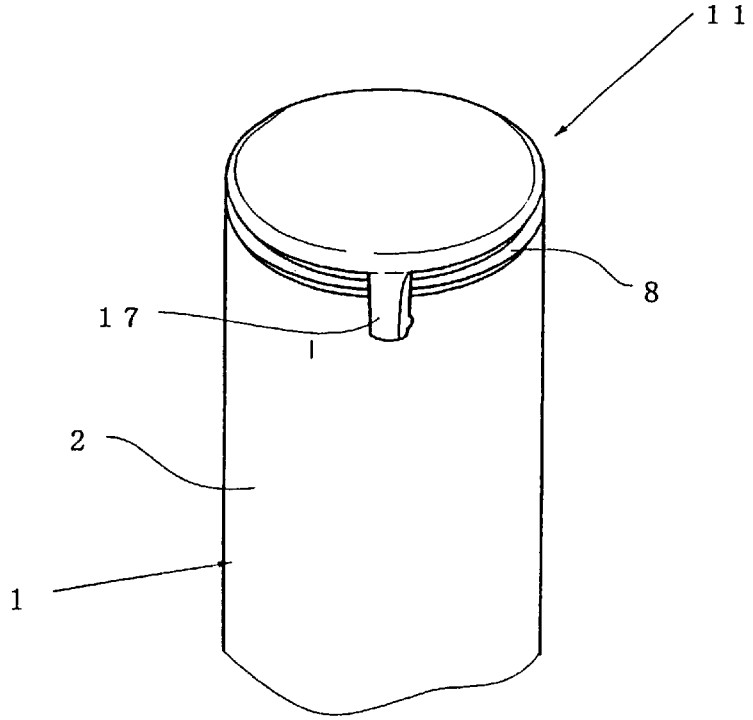
FIG. 6 is a perspective view of the container shown in FIG. 4.
Figure 7:
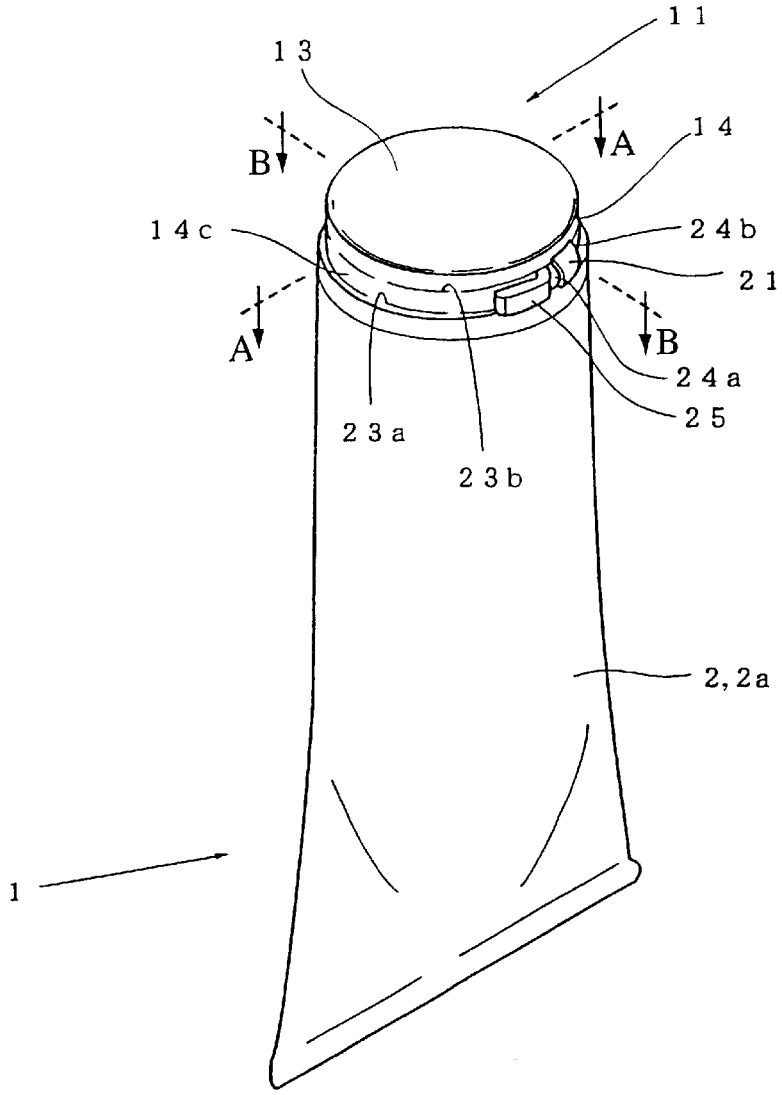
FIG. 7 is a perspective view of the container in a third embodiment of the present invention.
Figure 8:
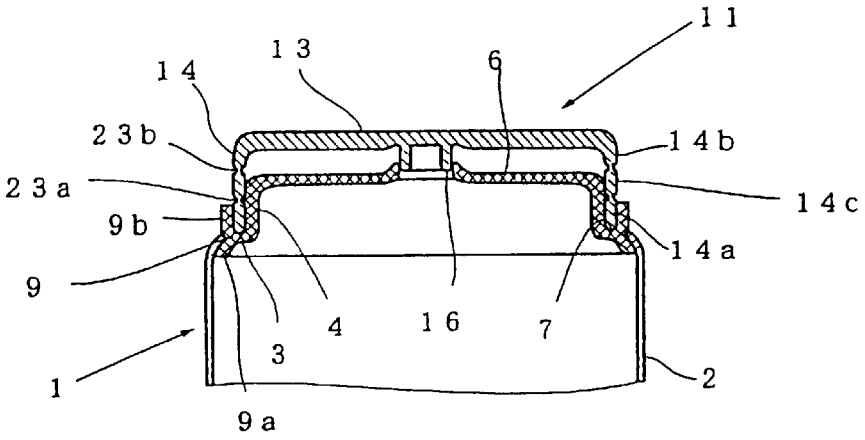
FIG. 8 is a vertical sectional view of the container in shown in FIG. 7 taken along an A—A line.
Figure 9:
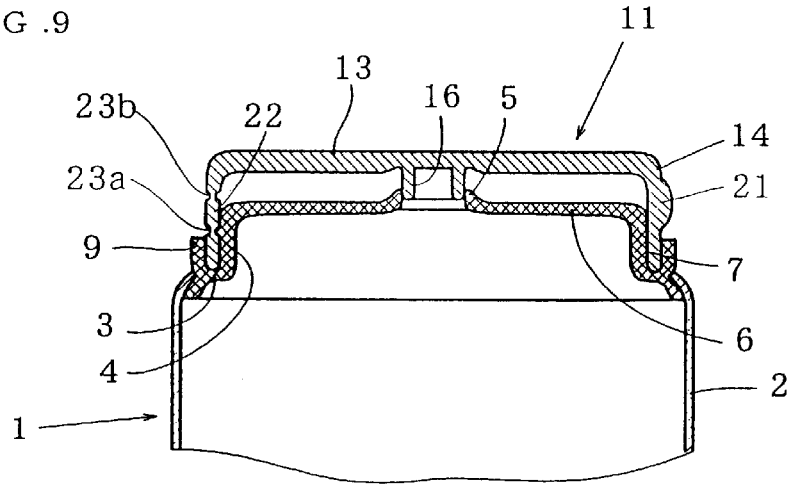
FIG. 9 is a vertical sectional view of the container in shown in FIG. 7 taken along a B—B line.
Figure 10:
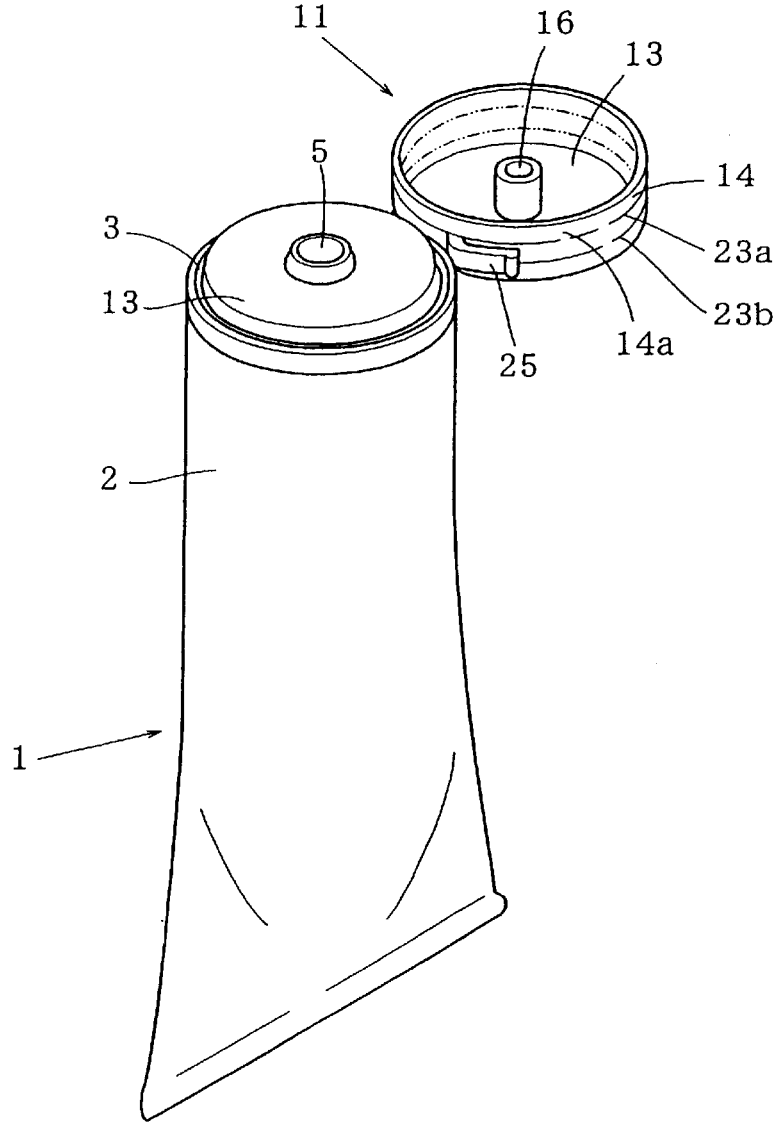
FIG. 10 is a perspective view of the container in FIG. 7 which is disassembled into a container body and a cap body.
Figure 11:
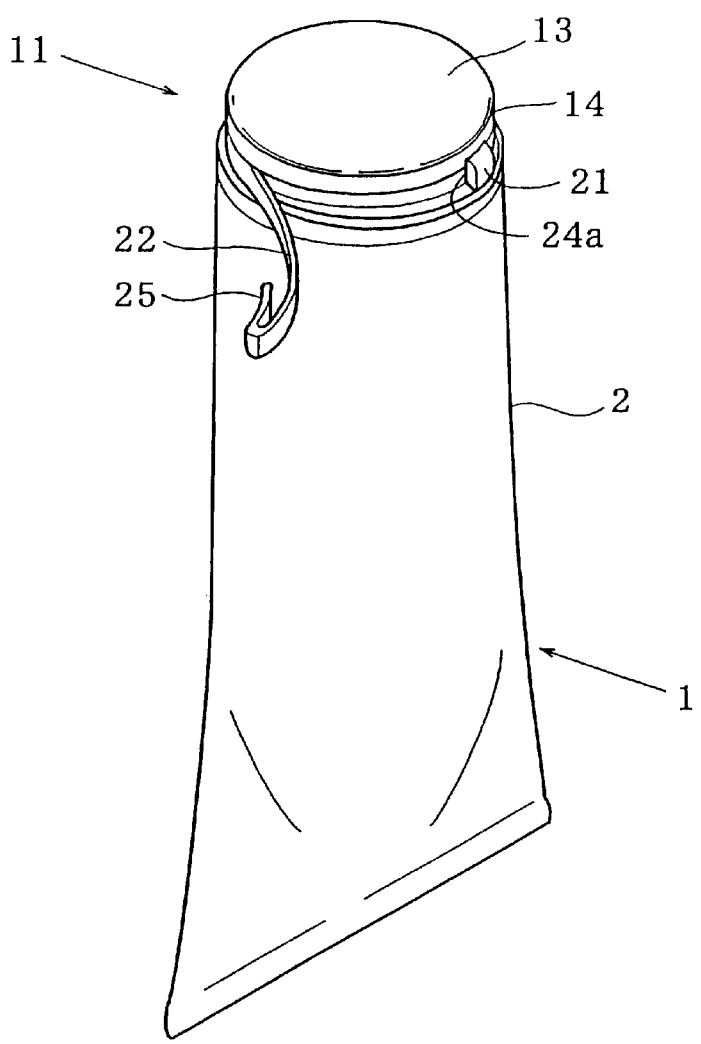
FIG. 11 is an explanation view of removing a removable belt from the container shown in FIG. 7.
Figure 12:
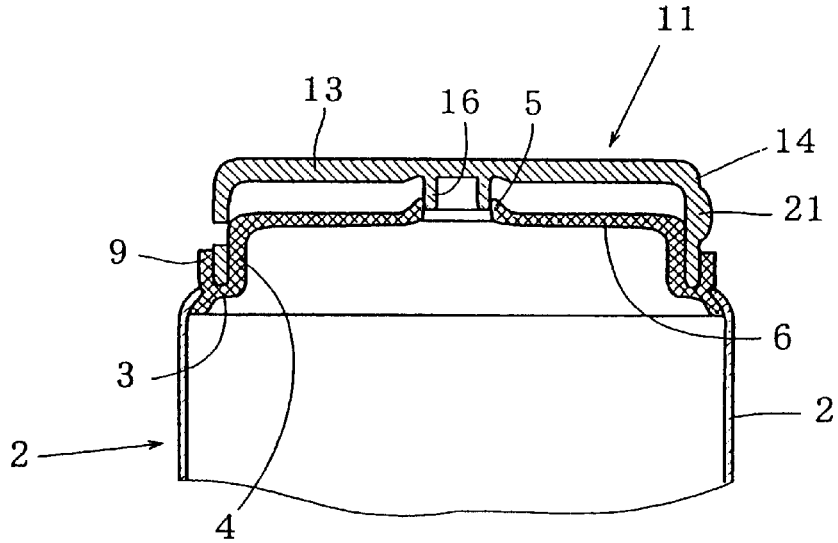
FIG. 12 is a vertical sectional view of the container after the removable belt shown in FIG. 11 is removed.

FIGS. 4 to 6 show a second embodiment of the present invention. The elements which are substantially equal to that of the first embodiment are designated by the numerals and then the explanation thereon should be omitted.

In the present embodiment, the depending cylinder 14 has a front portion from an outside of which an anti-opening plate 17 is depending. The lower portion of the anti-opening plate 17 is forcibly removably attached to the front upper portion of the trunk portion 2 by welding so as to prevent an unauthorized opening.

Moreover, the inward flanged wall 3 disclosed in the first embodiment is attached to the inner surface of a vertically intermediate portion of the mounting cylinder 9. And also, at the both sides of the thin hinge 15, a pair of springs 18 are formed for enabling an elastic turnover on the thin hinge.

FIGS. 7 to 12 show a third embodiment of the present invention. A primary feature of this embodiment is to provide the cap body according to the first embodiment with a seal mechanism. The elements substantially equal to those in the first embodiment are designated by the same number, and then omitting the explanation thereon.

The upper end portion of the trunk portion 2 is formed into a tapering cylinder 2*a* having a larger diameter at its low end, and the mounting cylinder 9 has a lower portion 9*a* which is fitted into the tapering cylinder, and the inner flanged wall 3 is attached to an intermediate portion (or the upper end of the lower portion) of the mounting cylinder 9, and the neck portion is erecting shortly from the inner periphery of the inward flanged wall 3. The mounting cylinder also has an upper portion 9*b* which is further shorter than the neck portion 4, and the fitting recessed groove 7 is formed between the neck portion and the upper portion of the mounting cylinder.

From the circumference of the cover plate 13, the depending cylinder 14 is extending downwardly as a peripheral wall. The depending cylinder 14 comprises a lower cylindrical portion 14*a* which is fitted into the fitting recessed groove 7 as the insert cylinder of the first embodiment, an upper cylindrical portion 14*b* which is attached directly to the circumference of the cover plate, and an intermediate cylindrical portion 14*c* which is merging into the lower cylindrical portion 14*a* and the upper cylindrical portion 14*b*.

A part of the intermediate cylindrical portion 14*c* is formed into a hinge portion 21, while the remainder of the same is formed into a removable belt 22 which is enclosed by a breaking line. Namely, a pair of first breaking lines 23*a*, 23*b* are formed at the upper and lower ends of the removable belt 22 for departing it from the upper and lower cylindrical portions, and a pair of second breaking lines 24*a*, 24*b* are formed at the circumferential ends of the removable belt for departing it from the hinge portion 21. And also, a knob 25 for tearing off the breaking lines is provided at the circumferential end of the removable belt 22 at the vicinity of the hinge portion 21. The knob 25 is formed into an L-shape protruding into a direction opposite to the hinge portion 21 as shown in the drawings.

In the above-mentioned construction, when the knob 25 is pulled towards a direction opposite to the hinge portion 21, the second breaking line 24 ruptures first, and so do the first breaking lines 23 successively. As a result, the removable belt 22 is taken away, and the depending cylinder 14 is divided into the lower cylindrical portion 14*a* and the upper cylindrical portion 14*b*. Although a gap is formed between these two cylindrical portions at that moment, however, it is possible to push the upper cylindrical portion 14*b* down to fit its lower end on the upper end portion of the neck portion to stop the water to permeate into the upper cylindrical portion 14*b*.

Figure 13:
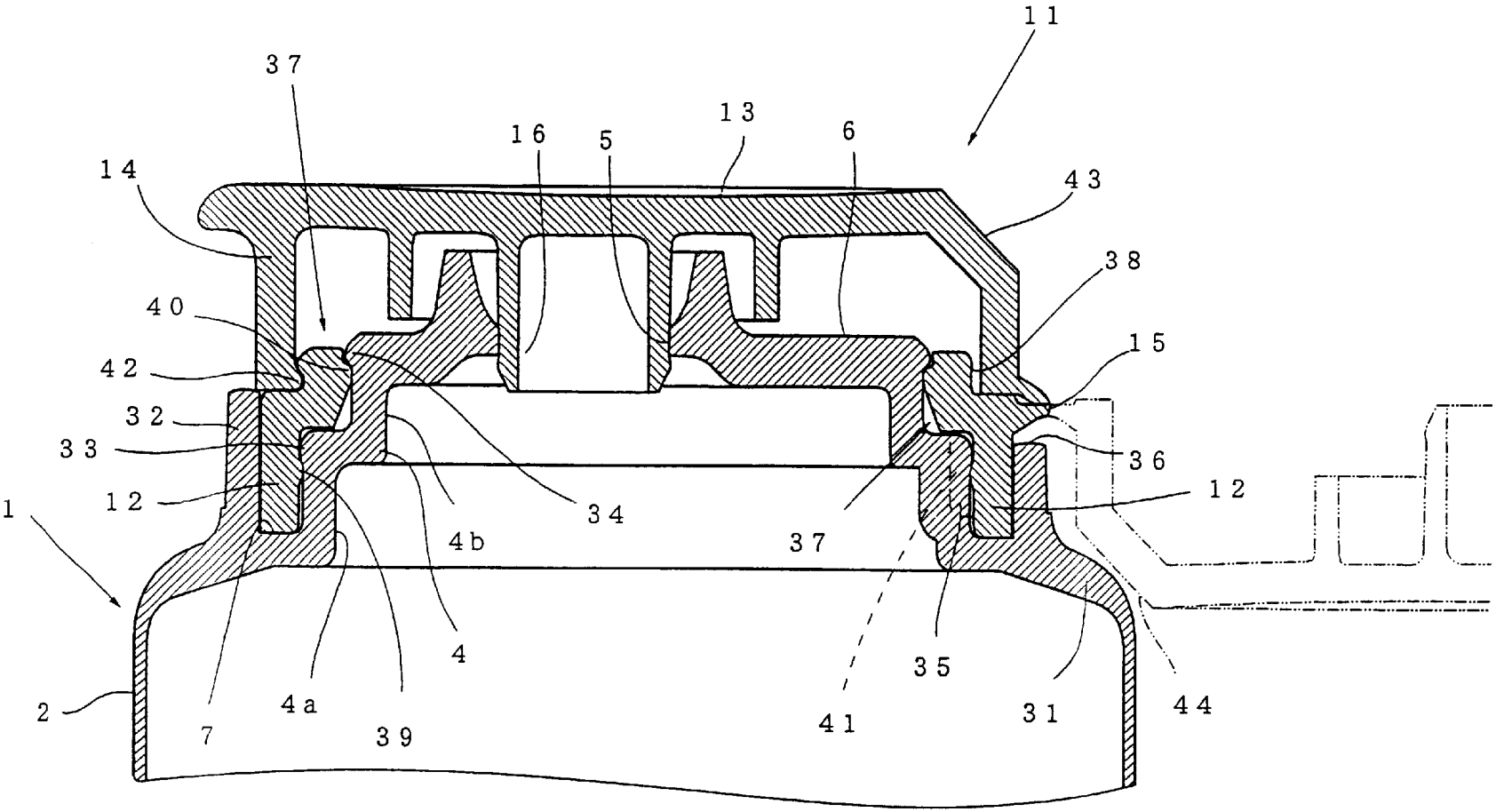
FIG. 13 is a vertical sectional view of the container in a fourth embodiment of the present invention.
Figure 14:
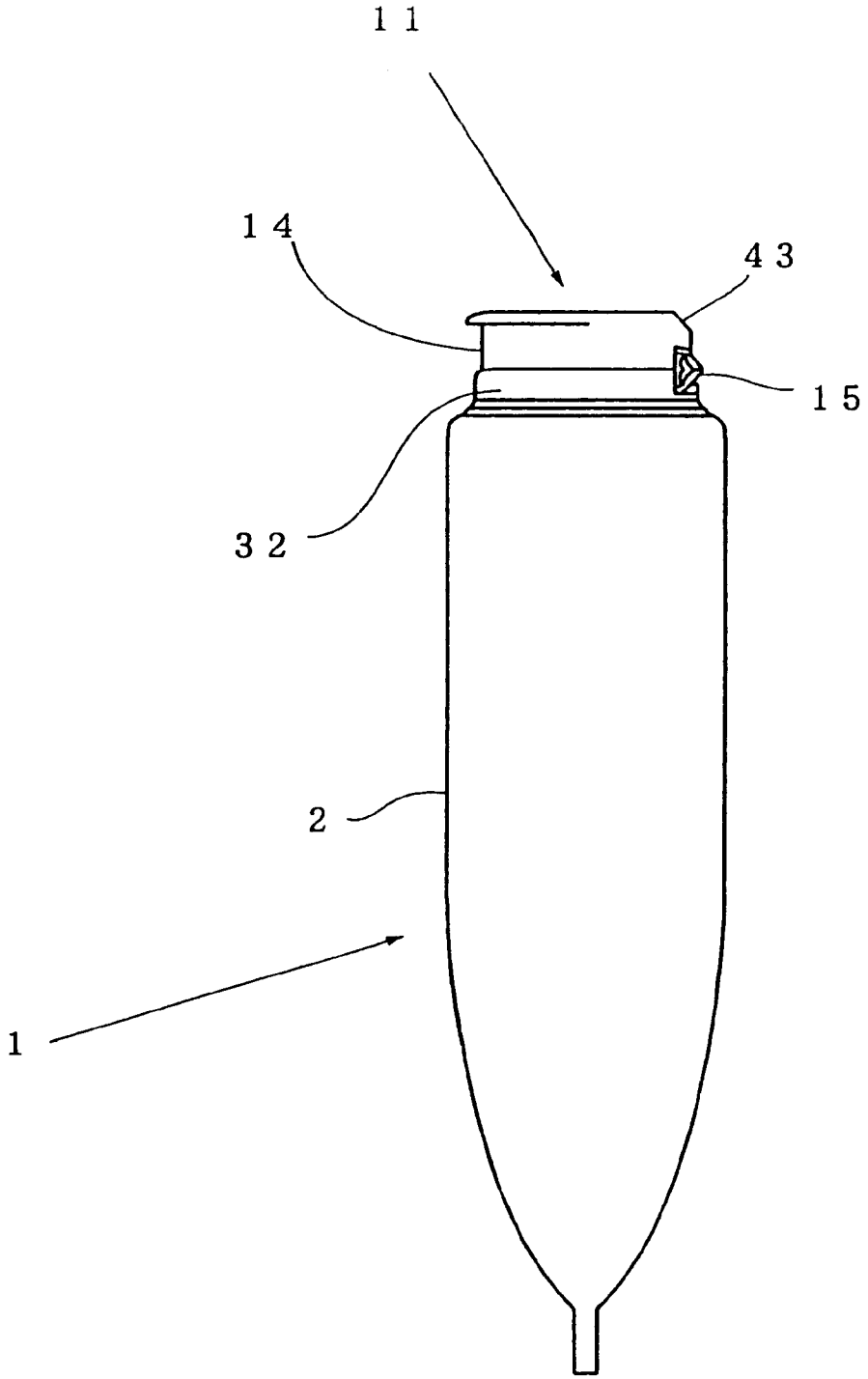
FIG. 14 is a side view of the container shown in FIG. 13.

FIGS. 13 and 14 show a fourth embodiment of the present invention.

Hereinafter, the words "front" and "rear", and "right" and "left" are used to show mutual relationship of the elements of the invention for facilitating the understanding of the specification.

The container according to the present embodiment has a short neck portion, and in relation to this, is adapted to prevent its shoulder from hitting against one end of a cover plate attached by a hinge.

A container body 1 has, as it does in the first embodiment, has an elastically squeezable, trunk portion 2 from which a large-diameter neck portion 4 is erecting shortly through a tapering shoulder 31, while a top surface of the neck portion 4 is closed by a top wall 6 with a discharge port 5. A short discharge cylinder may preferably be standing from the circumference of the discharge port as shown in the drawing.

A clipping cylinder 32 is standing from a generally intermediate portion of the shoulder 31 and encircling the neck portion 4, so as to form a fitting recessed groove 7 between the clipping cylinder and the neck portion. As shown in the drawings, the neck portion 4 has a lower half portion 4*a* from which an upper half portion 4*b* having a small external diameter through a step portion. Also in the drawings, a pair of first and second engagement ridges 33, 34 are respectively provided on the upper edges of the lower half portion 4*a* and the upper half portion 4*b* of the neck portion except one side of the neck portion (back side of the same in the shown embodiment). The lower half portion 4*a* is provided at the one side of the neck portion with a suitable number of first rotation-resisting ridges 35 extending vertically. A notched groove 36 for receiving a later-described hinge is formed at the back portion of the clipping cylinder 32, so as to reduce the height from the upper end of the trunk portion 2 to the upper face of the cover plate 13.

A cap body 11 has a ring-shaped basic portion 37 which is mounted to the neck portion 4. In the present embodiment, the ring-shaped basic portion 37 has an insert cylinder 12 fitted irremovably into the fitting recessed groove 7. In a preferred embodiment, the ring-shaped basic portion 37 may be formed by fitting the insert cylinder 12 into the fitting recessed groove, forming at the top of the insert cylinder an inward flange, from which a fixing cylinder 38 with a small external diameter is standing, and then fixing the fixing cylinder 38 firmly on the upper half portion of the neck portion at the outside thereof. A pair of third and fourth engagement ridges 39, 40 are formed at the insert cylinder 12 and the fixing cylinder 38 for engaging with the lower surfaces of the first and second engagement ridges 33, 34 respectively. And also, a second rotation resisting ridge 41 for engaging with the first rotation resisting ridge 35 is formed at the inner face of the back portion of the insert cylinder 12.

The ring-shaped basic portion 37 is connected to a depending cylinder 14 at the lower end of its back portion through a thin hinge 15. Said depending cylinder 14 is depending from the circumference of the cover plate 13, while the upper surface of the cover plate 13 is formed into a horizontal flat surface defining a ground contacting surface, usable in the inverted posture of the container. The depending cylinder 14 is provided at the inner face of its front with a rib for engaging with the lower another rib formed laterally on the front of the fixing cylinder 38. A cylindrical plug 16 for closing the discharge port 5 is depending from the lower surface of the cover plate 13.

Over the thin hinge 15, a joint or a connecting portion between the upper rear portion of the depending cylinder 14 and the rear portion of the cover plate 13 is chamferred as shown in FIG. 13 to form a slant wall 43 for preventing it from hitting against the shoulder when the cover plate is opened. The slant wall is sloping from an upper front to a lower back direction, such that the upper surface of the slant wall may come closer to or contact with an angular portion 44 at the circumference of the shoulder in an opened cover state, but the slant wall does not hit against the angular portion. As a result, the hinge is not damaged, nor the cap body slips out from the neck portion due to the hitting.

Figure 15:
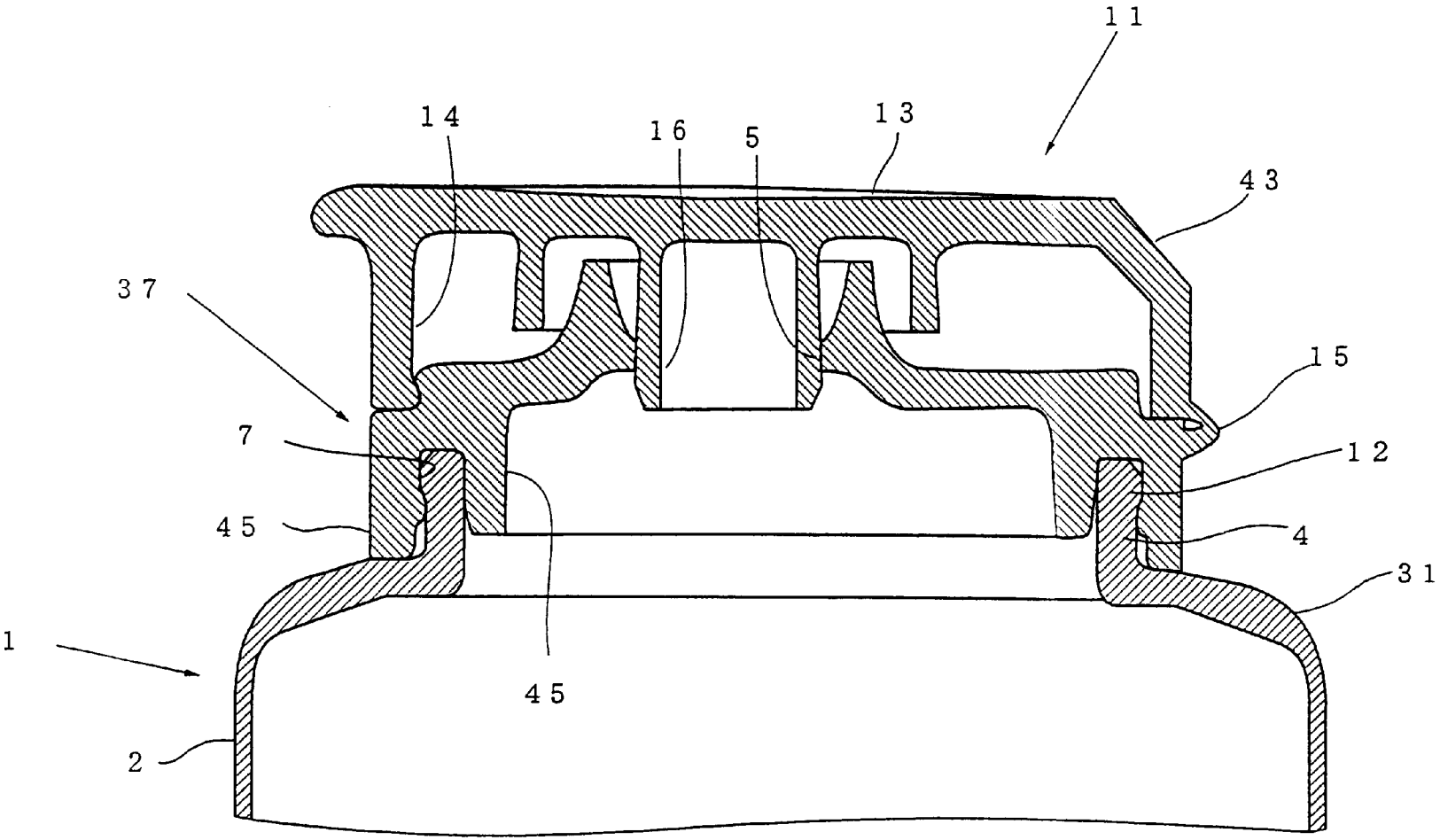
FIG. 15 is a vertical sectional view of the container in a fifth embodiment of the present invention.

FIG. 15 shows a fifth embodiment of the present invention.

In this embodiment, contrary to the fourth embodiment, the fitting recessed groove 7 mentioned above is formed in the cap body, while the insert cylinder is formed in the container body. Hereinafter, the explanation on the element which is the same to that of the fourth embodiment is omitted.

A container body 1 has a trunk portion 2 from which a neck portion 4 is erecting through a shoulder 31, and the upper portion of the neck portion is formed into an insert cylinder 12.

The cap body 11 has a ring-shaped basic portion 37, from the underside of which a double cylinder 45 is depending. The double cylinder consists of an inner cylinder and an outer cylinder, between which a fitting recessed groove 7 opened downward is formed. The insert cylinder 12 is irremovably fixed into the fitting recessed groove, such that the cap body is mounted to the neck portion. Moreover, the upper face of the ring-shaped basic portion 37 is closed by a top wall 6 with a discharge port 5. Said top wall is integrally formed with the ring-shaped basic portion.

Figure 16:
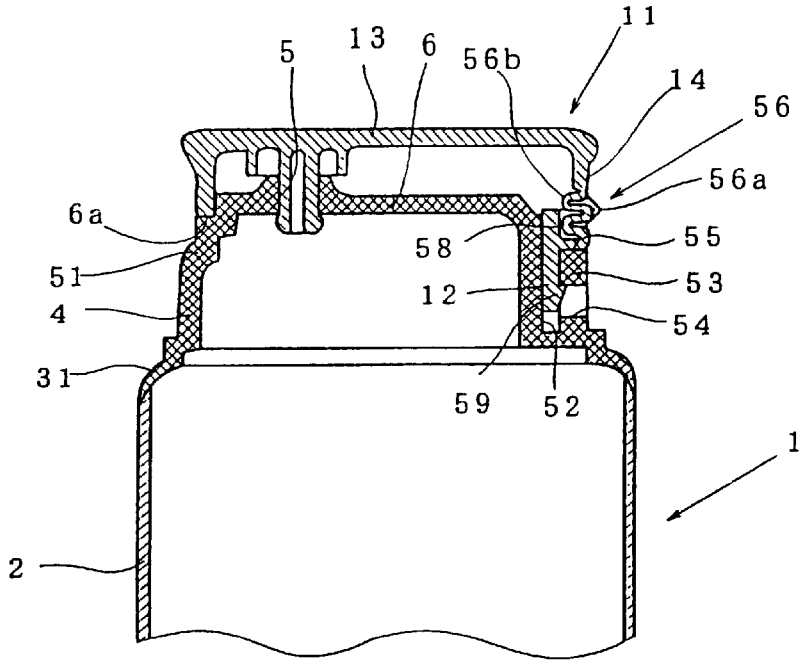
FIG. 16 is a vertical sectional view of the container in a sixth embodiment of the present invention.
Figure 17:
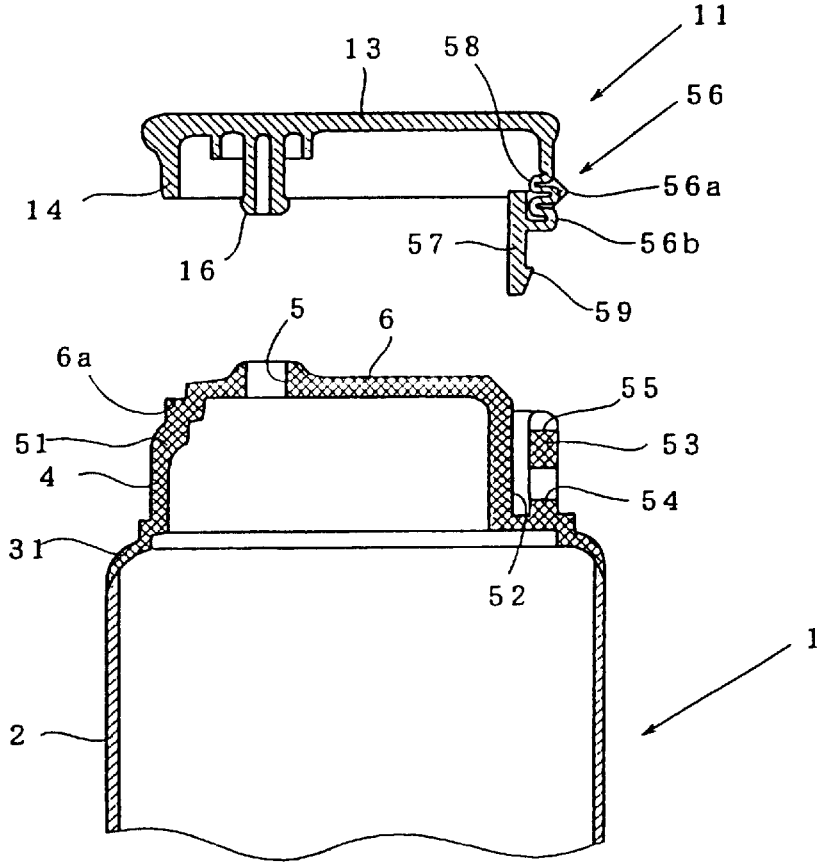
FIG. 17 is a vertical sectional view of the container shown in FIG. 16 in a disassembled state.
Figure 18:
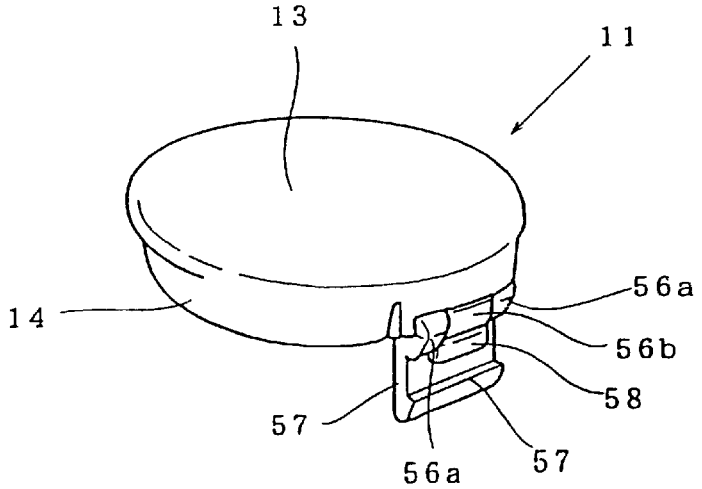
FIG. 18 is a perspective view of the container shown in FIG. 16 in a disassembled state.
Figure 18:
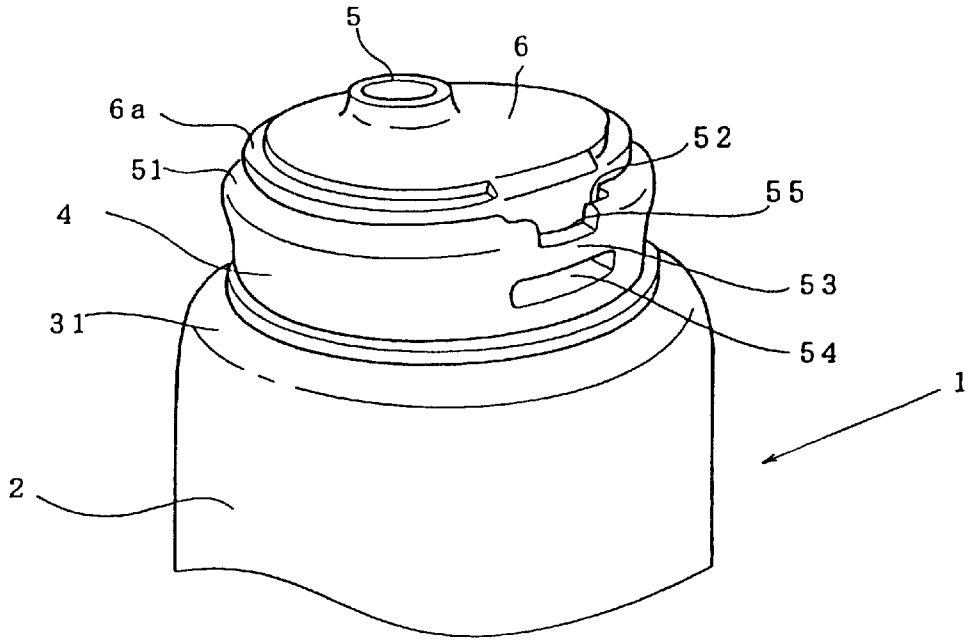

FIGS. 16 to 18 show a sixth embodiment of the present invention.

This embodiment proposes a cap body with a flat insert plate instead of the insert cylinder shown in the first embodiment.

In this embodiment, a container body 1 has an elastically squeezable, trunk portion 2 from which a neck portion 4 is erecting through a shoulder 31, and the upper surface of the neck portion is closed by a top wall 6 with a discharge port 5. It is preferable that the top wall, the neck portion, and the shoulder are formed into an integral head portion 51, and the lower end of the shoulder is connected with and merging into the upper end of the trunk portion 2. This construction may be formed by a so-called down-process method shown in Japanese Patent Publication No. 38 (A.D.1963)-23485. In this process, a synthetic resin sheet is punched by a cylindrical cutter for stamping out a disc, the periphery of which is connected by welding to the leading end of a synthetic resin sleeve for forming a trunk portion having an outer diameter equal to the inner diameter of the cylindrical cutter, and then the disc is compressed into the head portion. Alternatively, the head portion may be made of injection molding, and the lower end of the head portion is welded to the upper end of the trunk portion by heat or high-frequency wave.

The top wall 6 has one side, a back side for example, which is recessed to form a deep groove 52 for fixing a later described insert plate. The deep groove has a narrow shape extending into the left and right in a top view shown in FIG. 18, or circumferential direction of the neck portion. The deep groove 52 has a depth which is generally equal to the neck portion, such that the neck portion 4 may be formed as short as possible, while securing a required length of the insert plate. As one of a preferred embodiment, the neck portion 4 has a rear wall 53, the front surface of which forms a rear side of inner wall surface of the deep groove 52. Also, in another preferred embodiment, The rear wall 53 may have at a lower part of its front face a blind hole or a through hole, for example an engagement hole 54 opening back and forth as shown, for engaging with a later-described engagement projection. Moreover, the rear wall 53 also has an upper end surface with its lengthwise intermediate portion is recessed to form a fitting recess 55 for resting a later-described elastic band plate. Furthermore, an annular step 6*a* for resting the lower end of the later-described depending cylinder 14 is formed at the circumference of the top wall as shown in the drawing.

A cap body 11 has a cover plate 13 from a periphery of which a depending cylinder 14 is extending downwards, and an insert plate 57 which is depending through a hinge mechanism 56 from the lower end of a rear portion of the depending cylinder 14. The insert plate 57 is fitted into the deep groove 52 so as to connect the cap body 11 to the head portion 51 of the container body. The hinge mechanism 56 may preferably comprises, as shown in the drawings, a pair of first hinges 56*a*, 56*a* for connecting the left and right sides of the upper end of the insert plate 57 to the lower end of the rear portion of the depending cylinder 14, and a second hinge 56*b* formed between the first hinges. The second hinge 56*b* has a band-like elastic plate 58 which has a zigzag section and connects the intermediate portion of the insert plate to the lower end of the depending cylinder 14. Due to the zigzag section, the elastic band has a larger allowance for elastic deformation for preventing that an excessive stress is concentrated on a joint between the ends of the elastic band and the cover plate or the insert plate, even in a tube container having a short neck portion, which is a subject matter of the present invention. By the way, the basic structure,i.e., a zigzag sectional configuration, is common to that of international application PCT/CH92/00021 (i.e. Japanese patent Laid Open No.5 (A.D. 1993)-505786). However, in the present invention, for making the neck portion 4 shorter while forming the zigzag portion of the band-like elastic plate long enough, the lower end of the elastic plate 58 is connected to the lengthwise intermediate portion of the insert plate at its outside, not to the upper end of the insert plate. More in detail, the said plate has an upper part which is exposed to an outside through the fitting recess 55, and a lower end portion of the elastic plate is protruding outwards from the lower end of the upper part and placed on the fitting recess, while the remainder of the elastic plate is bent and standing up from the lower end portion of the same.

The insert plate 57 is provided at its lower end portion with an engagement projection 59 projecting backwards from the lower end portion and engaging with the engagement hole so as to prevent the insert plate from slipping out upwards.

Figure 19:
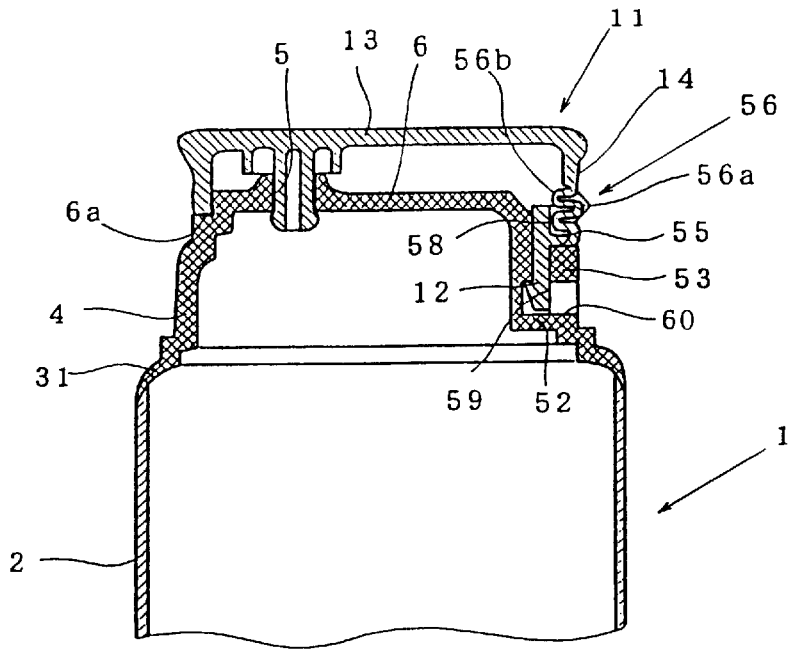
FIG. 19 is a vertical sectional view of the container in a seventh embodiment of the present invention.
Figure 20:
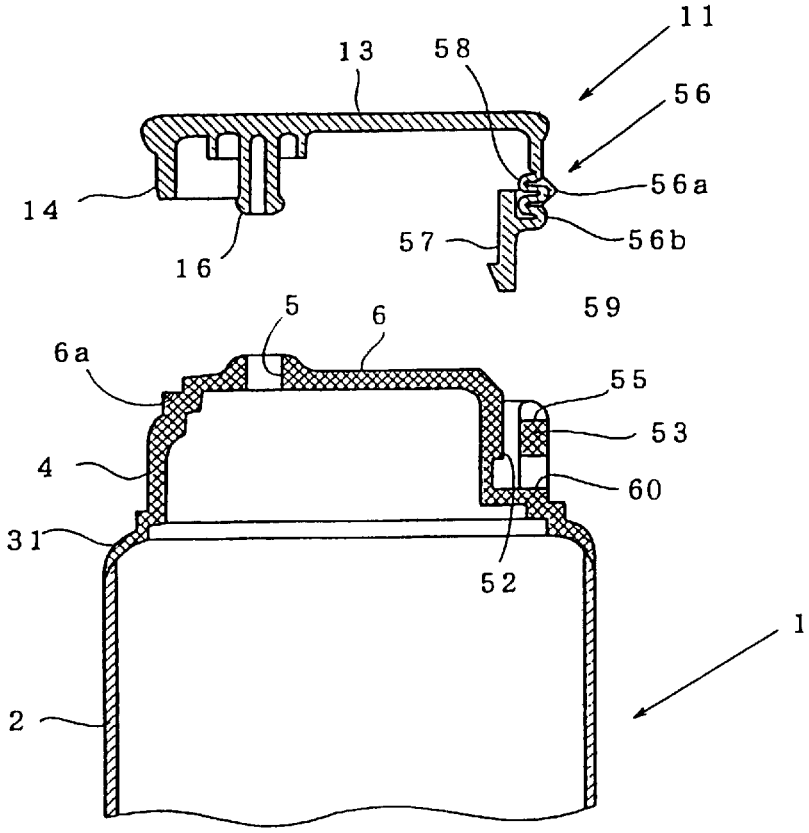
FIG. 20 is a vertical sectional view of the container shown in FIG. 19 in a disassembled state.
Figure 21:
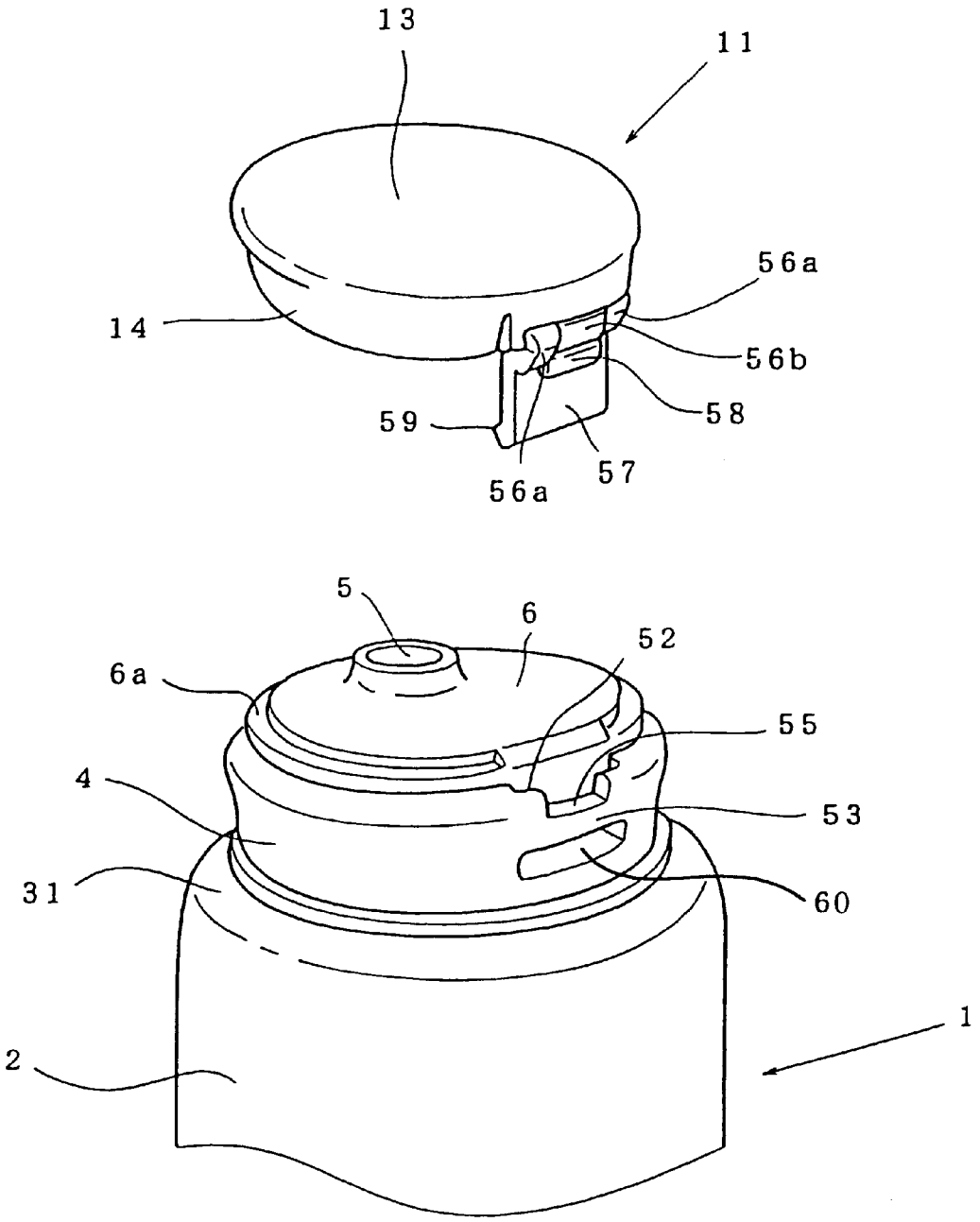
FIG. 21 is a perspective view of the container shown in FIG. 19 in a disassembled state.

FIGS. 19 to 21 show a seventh embodiment.

This embodiment is generally corresponding to the six embodiment, except that a deep groove 52 has a front wall which is provided at its lower portion with an engagement hole 60, and an engagement projection 59 which is protruding forward from the lower end of the insert plate 57 and inserted into the engagement hole 60. The explanation on other elements which are the same to-those of the six embodiment is omitted.

Figure 22:
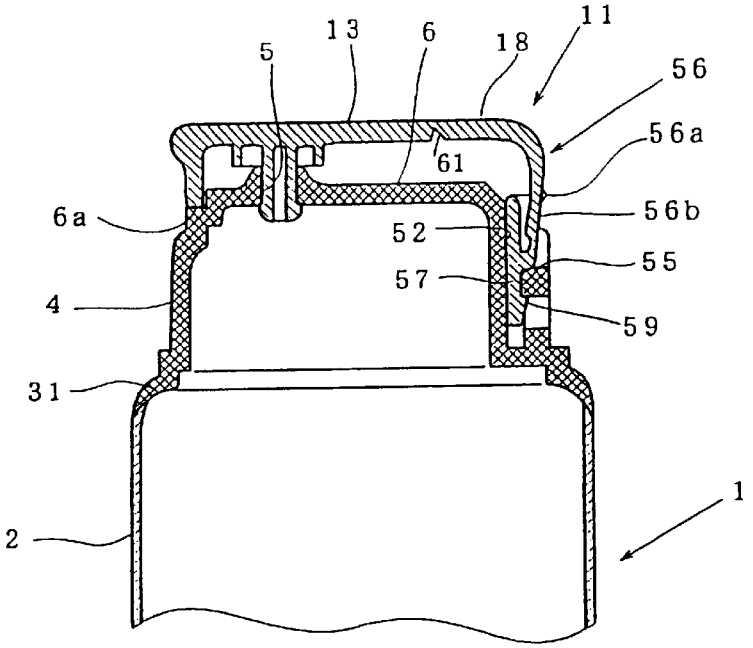
FIG. 22 is a vertical sectional view of the container in an eighth embodiment of the present invention.
Figure 23:
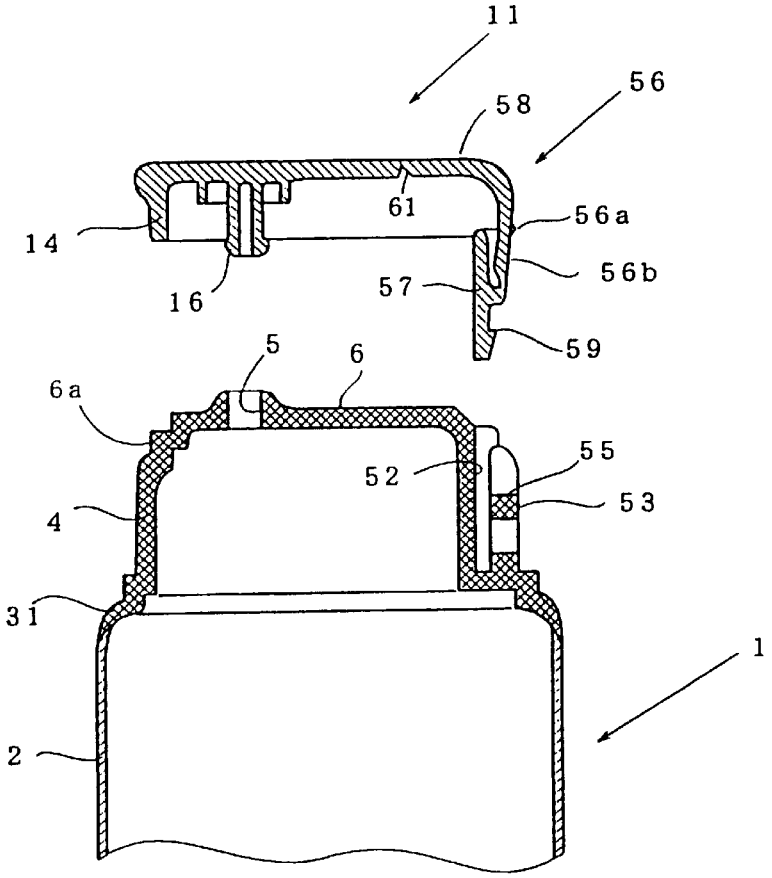
FIG. 23 is a vertical sectional view of the container shown in FIG. 22 in a disassembled state.
Figure 24:
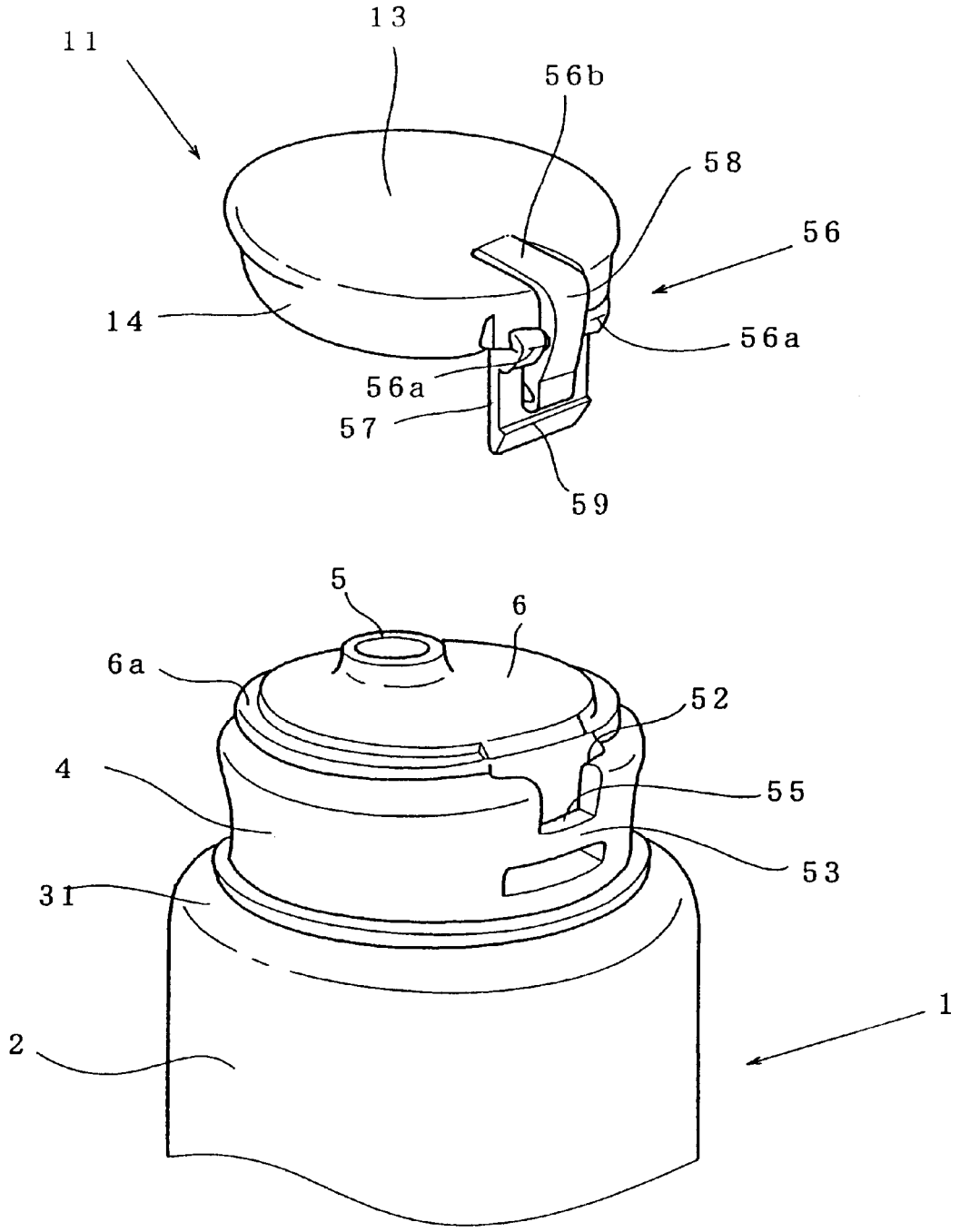
FIG. 24 is a perspective view of the container shown in FIG. 22 in a disassembled state.

FIGS. 22 to 24 show an eighth embodiment of the present invention.

This embodiment is also generally corresponding to the sixth embodiment, except that the hinge mechanism disclosed therein is replaced by a known, three point hinge mechanism. This three point hinge is formed by removing a zigzag elastic plate from the hinge mechanism in the six embodiment, while a notch 61 is formed at the cover plate and depending cylinder from a portion between the the pair of the first hinges to the rear portion of the cover plate. A band-like elastic band 58 is connecting the front end of of the notch to the rear side of the insert plate 57. The explanation on the other elements which are the same to the six embodiment is omitted.

Figure 25:
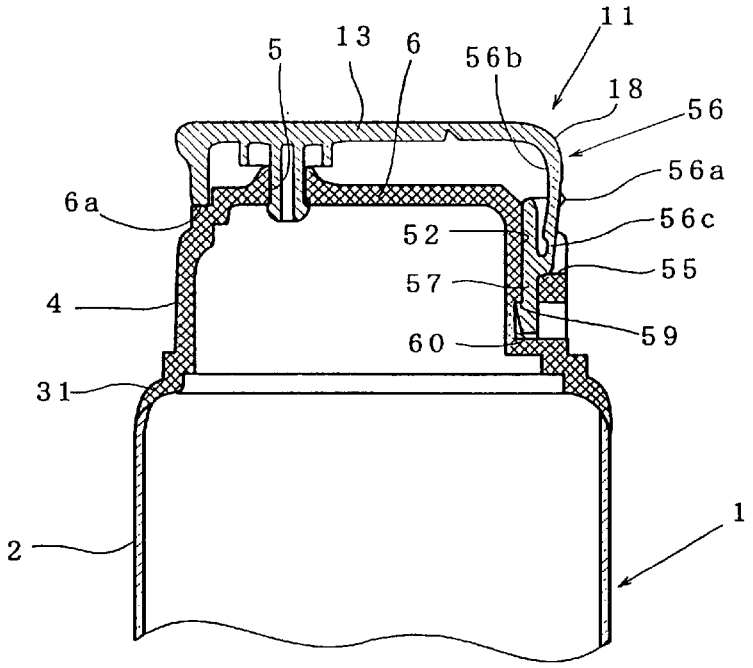
FIG. 25 is a vertical sectional view of the container in a ninth embodiment of the present invention.
Figure 26:
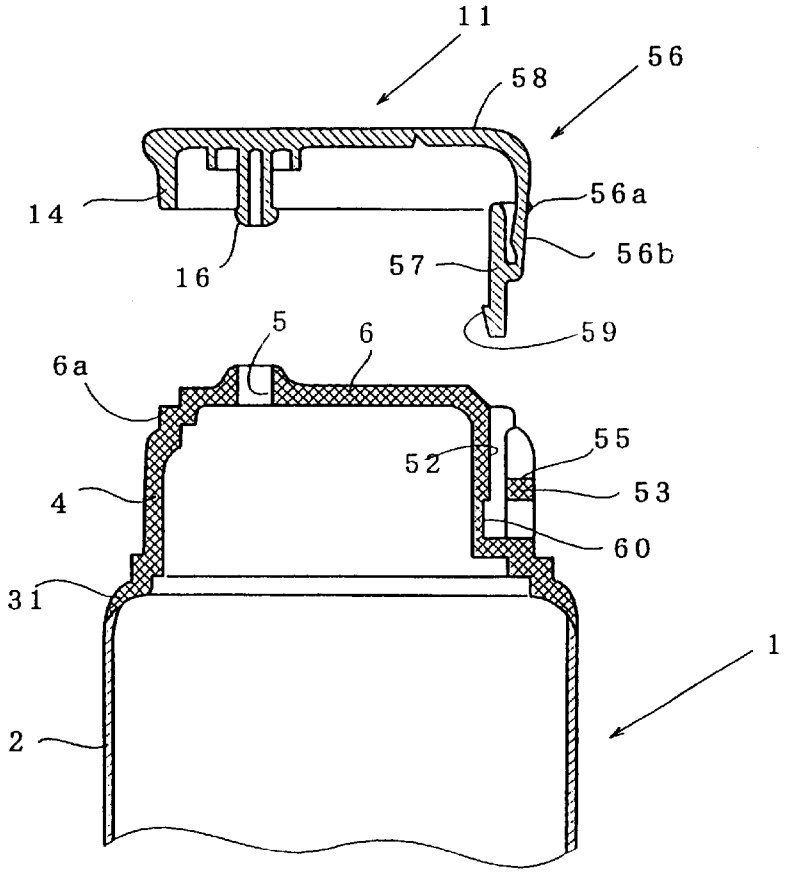
FIG. 26 is a vertical sectional view of the container shown in FIG. 25 in a disassembled state.
Figure 27:
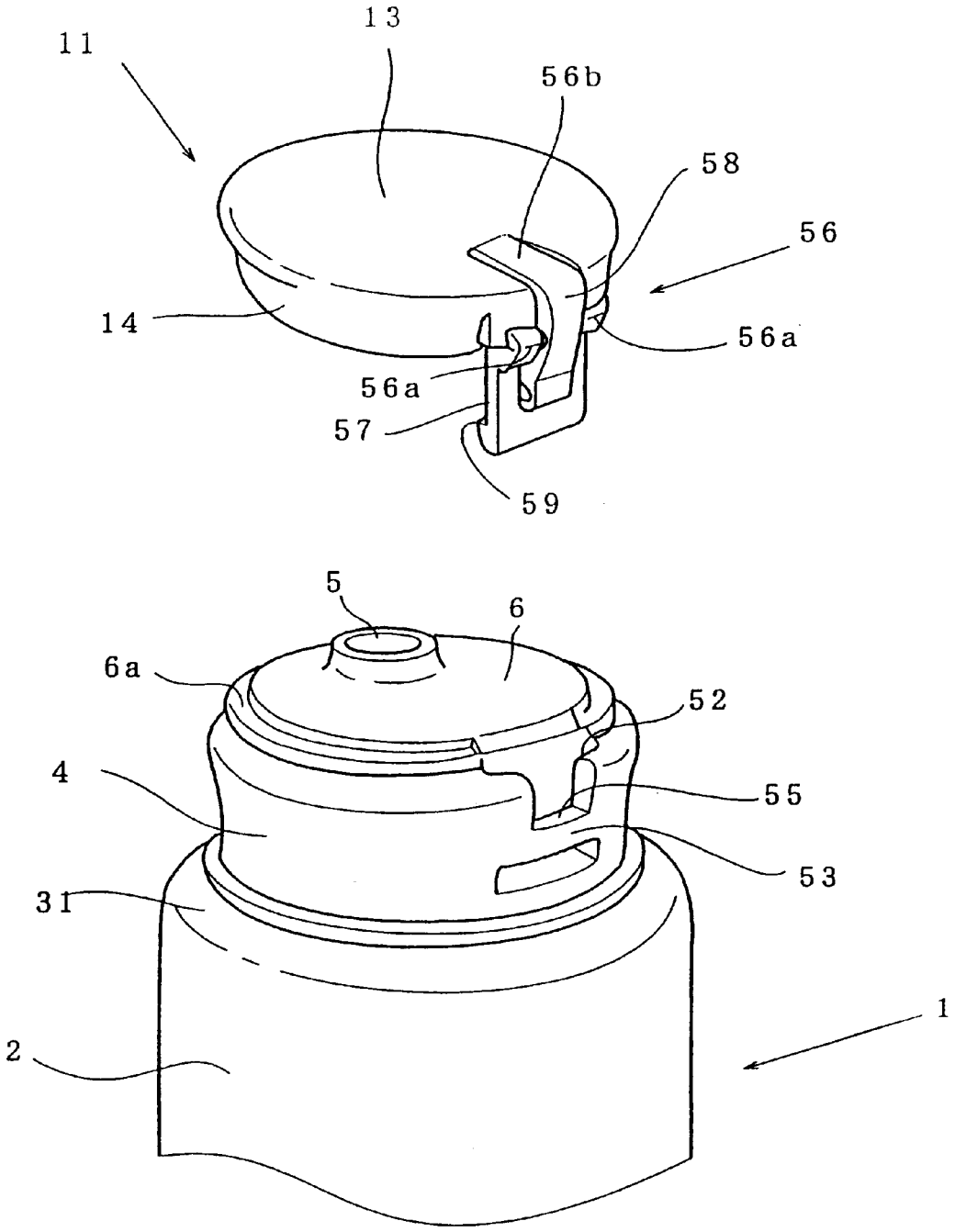
FIG. 27 is a perspective view of the container shown in FIG. 25 in a disassembled state.

FIGS. 25 to 27 show a ninth embodiment of the present invention.

This embodiment is generally corresponding to the eighth embodiment, except that an engagement projection 59 extending forward from the lower end of the insert plate 57 is inserted into an engagement hole 60 formed at the lower portion of a front wall of the deep groove 52.

Figure 28:
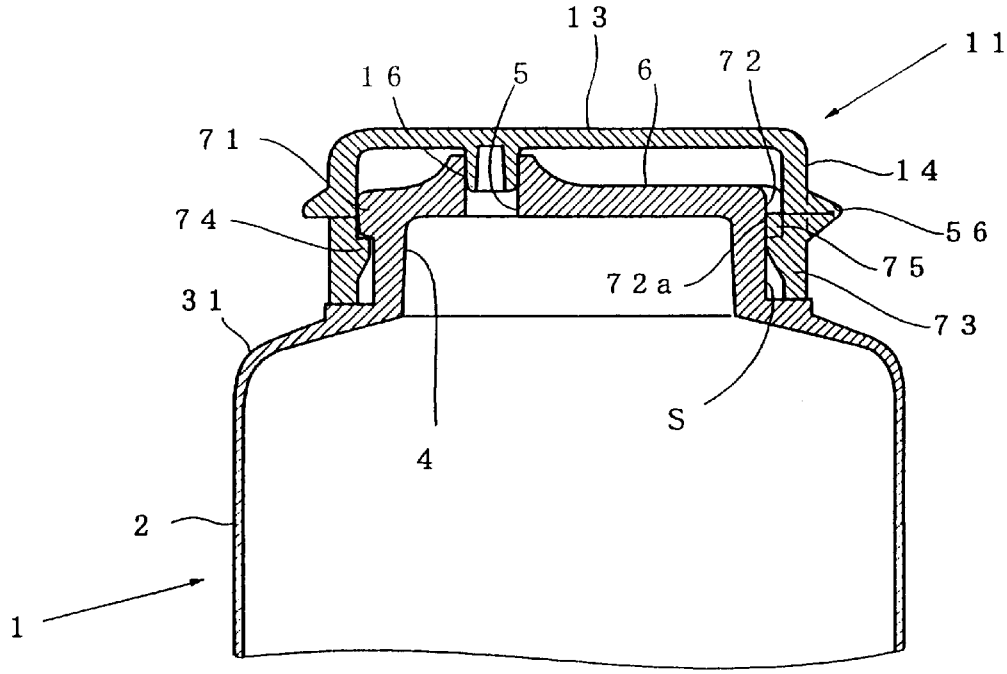
FIG. 28 is a vertical sectional view of the container in a tenth embodiment of the present invention.
Figure 29:
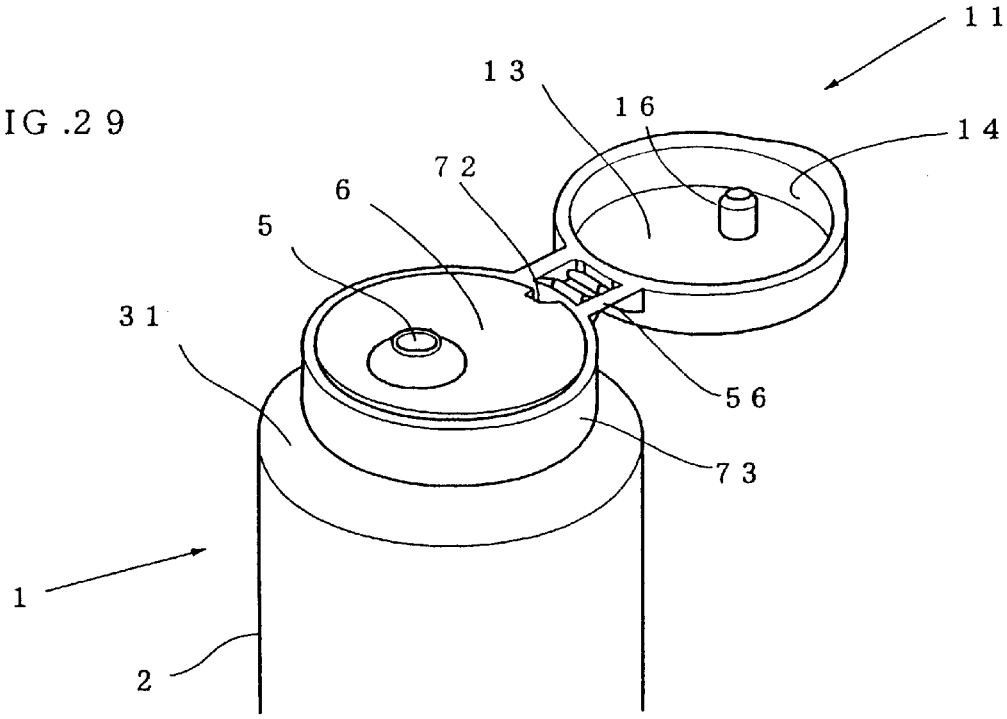
FIG. 29 is a perspective view of the container shown in FIG. 28 in an open state.
Figure 30:
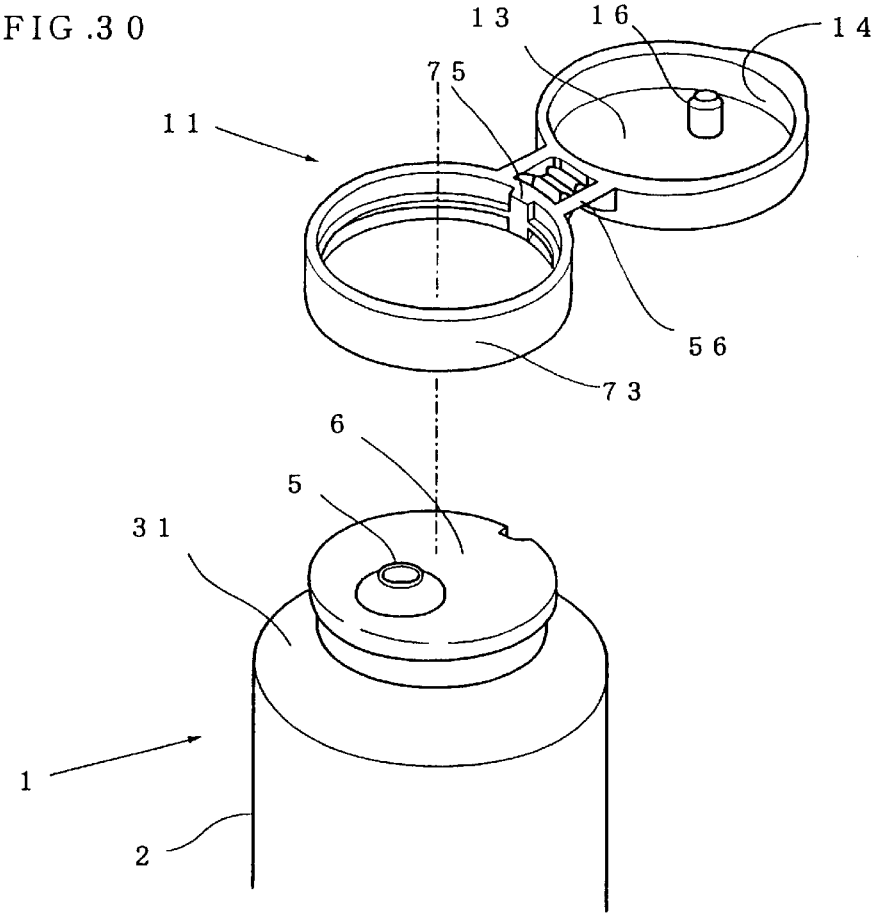
FIG. 30 is a perspective view of the container shown in FIG. 28 in a disassembled state.

FIGS. 28 to 30 show a tenth embodiment of the present invention.

In this embodiment, a cap body has a fitting cylinder for fitting firmly on the outside of the neck portion in stead of the insert cylinder for inserting into the fitting groove disclosed in the first embodiment.

A container body 1 has an elastically squeezable, trunk portion 2 from which a neck portion 4 is erecting through a shoulder 31, and the upper surface of the neck portion 4 is closed by a top wall 6 with a discharge port 5, the periphery of the top wall being connected to the upper end of the neck portion. The neck portion 4 has an upper half portion which is formed into a large external diameter portion 71 for fixing the fitting cylinder. A vertical groove 72 for fitting a later-described vertical ridge is formed at a side surface (a rear surface for example) of the large external diameter portion 71. The bottom surface 72*a* of the vertical groove 72 and the rear surface S of a lower half portion of the neck portion 4 are generally on a same flat plane as shown in FIG. 28.

The cap body 11 has a short fitting cylinder 73 which is fitted irremovable on the neck portion, and a cover plate 13 which is connected to the upper portion of the fitting cylinder through a hinge mechanism 56. A plug 16 for closing the discharge port 5 is depending from the underside of the cover plate.

As a preferred embodiment, the upper portion of the fitting cylinder 73 is fitted on the lower part of the large external diameter portion 71. And moreover, the fitting cylinder has a vertically intermediate portion, at the inside of which a fifth engagement ridge 74 is formed circumferentially, such that the fifth engagement ridge is engaged to the lower surface of the large external diameter portion 71 for preventing the fitting cylinder 73 from slipping out upwardly. In further preferred embodiment, a vertical ridge 75 is extending vertically at one side (for example rear side) of the inner face of the fitting cylinder and intersecting the fifth engagement ridge 74, such that the vertical ridge 75 is fitted into the vertical groove 72 so as to prevent the rotation of the fitting cylinder 73 around the neck portion 4. Due to this feature, when the discharge port 5 is located in an eccentric position deviating away from the center of the top wall as shown in FIG. 30 for example, the plug 16 is free from dislocating from the discharge port due to the rotation, and able to fit therein.

Figure 60:
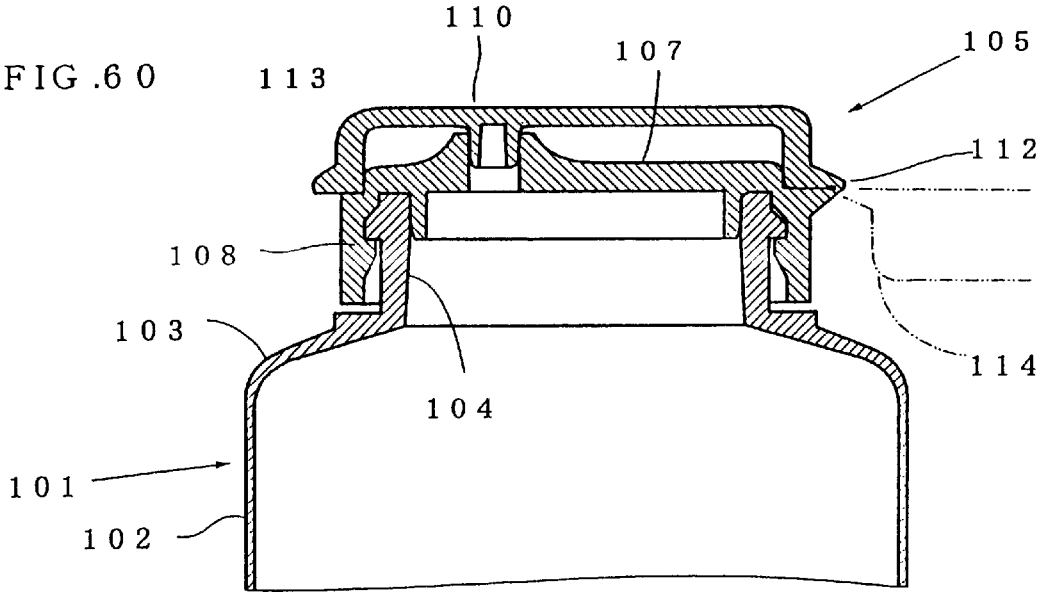
FIG. 60 is a vertical sectional view of another conventional container.

Although in the conventional container shown in FIG. 60 the top wall for closing the top of the neck portion is jointed at its circumference to the upper end of the mounting cylinder fitted on the neck portion, while on the other hand, in the present embodiment, the top wall 6 with the discharge port is connected directly to the upper end of the neck portion. This feature contributes to avoid the disadvantage of the conventional container that the height from the top of the trunk portion to the upper surface of the cover plate is increased by the thickness of the joint portion between the top plate and the mounting cylinder.

Figure 31:
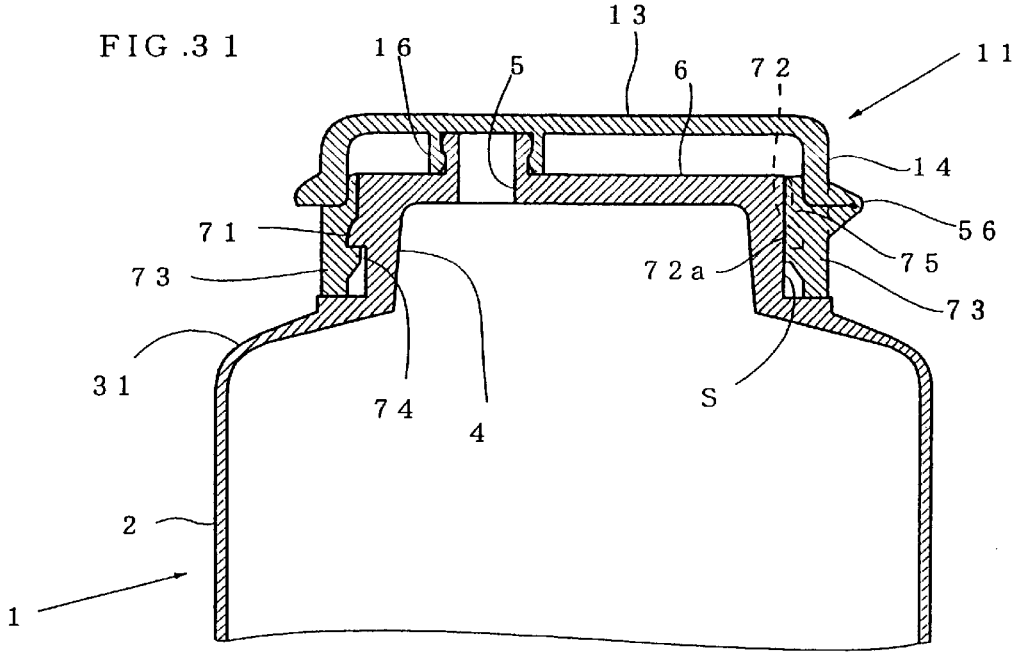
FIG. 31 is a vertical sectional view of the container in an eleventh embodiment of the present invention.
Figure 32:
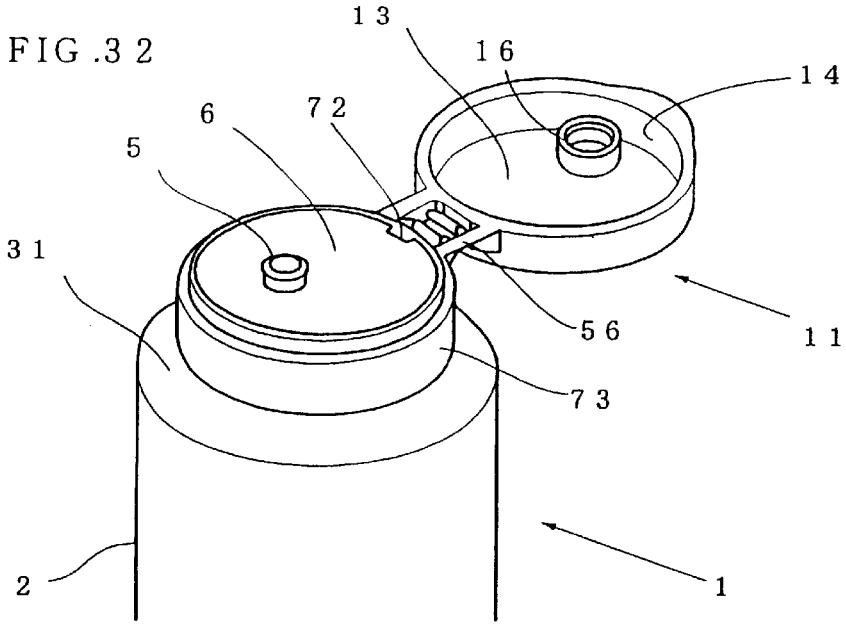
FIG. 32 is a perspective view of the container shown in FIG. 31 in an open state.
Figure 33:
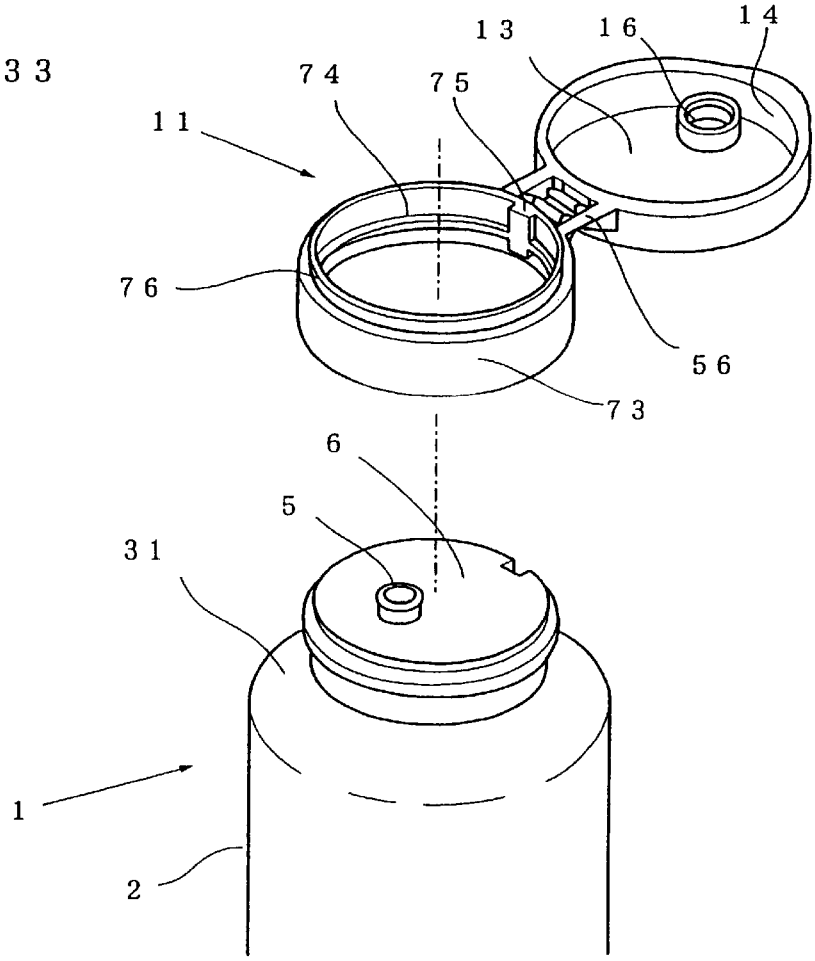
FIG. 33 is a perspective view of the container shown in FIG. 31 in a disassembled state.

FIGS. 31 to 33 show an eleventh embodiment of the present invention.

This embodiment is generally the same to the tenth embodiment, except that the fitting cylinder 73 has an upper end portion which is erecting from a step portion such that the end portion is formed into a small diameter portion. The upper surface of the small external diameter portion and the upper surface of the top wall 6 are generally on a common plane. And also, a depending cylinder 14 is depending from the periphery of the cover plate 13, and has a lower end portion, with its lower and external surfaces fitting to the upper surface of the step portion and the external surface of the small external diameter portion.

The construction of the present embodiment is especially useful, when the container body 1 is made of a soft synthetic resin which is suitable for forming an elastically squeezable trunk portion, the cap body 11 is a non-soft synthetic resin. When the depending cylinder made of a hard synthetic resin is fitted directly to the neck portion made of the soft synthetic resin, frictional resistance increases at the time of the fitting due to the elastic deformation of the upper end portion of the neck portion. However, such an inconvenience does not occur in this embodiment by fitting the depending cylinder on the hard small external diameter portion.

Figure 34:
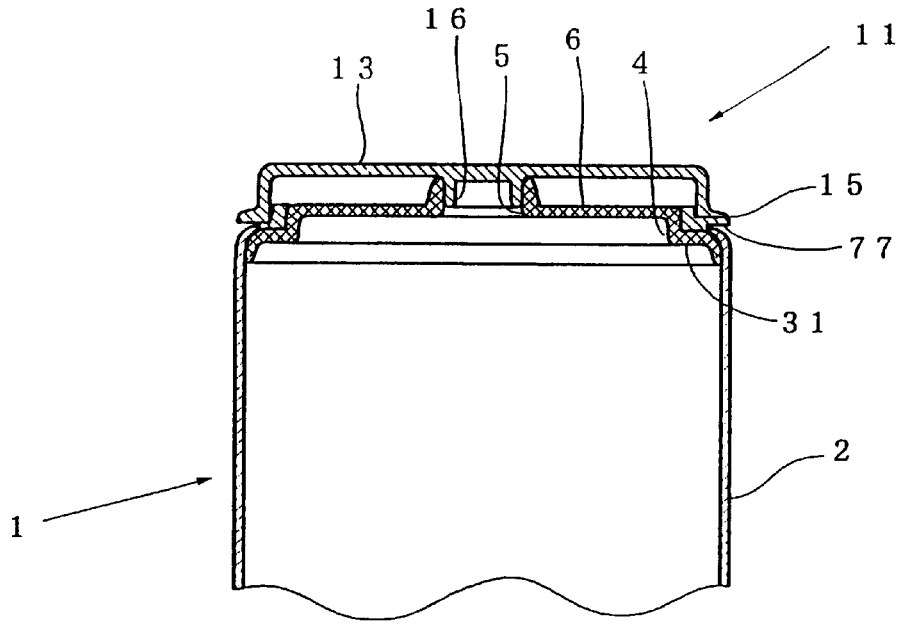
FIG. 34 is a vertical sectional view of the container in an twelfth embodiment of the present invention.
Figure 35:
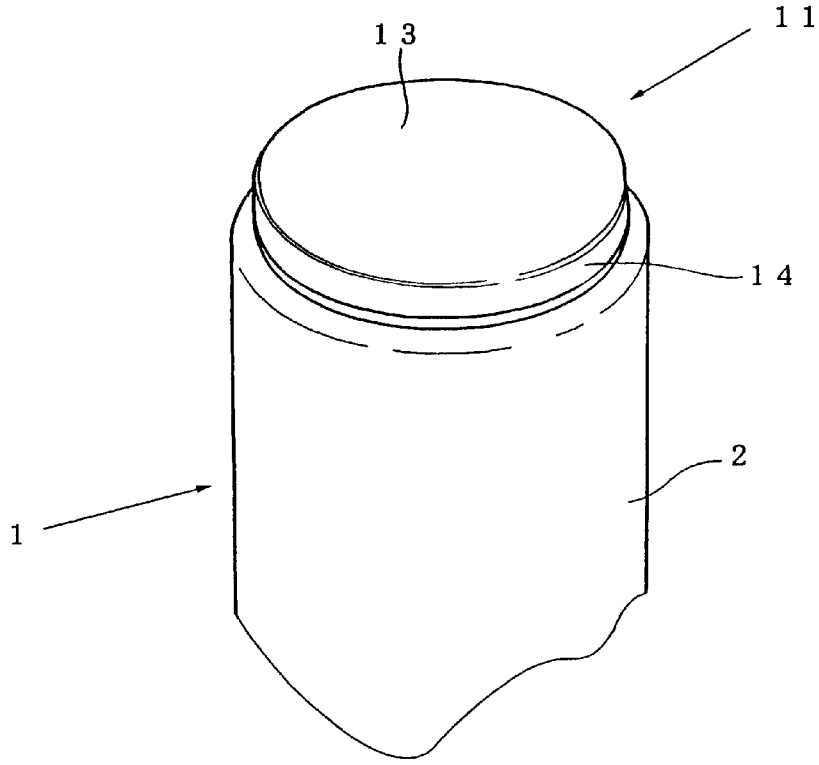
FIG. 35 is a perspective view of the container shown in FIG. 34 in a closed state.
Figure 36:
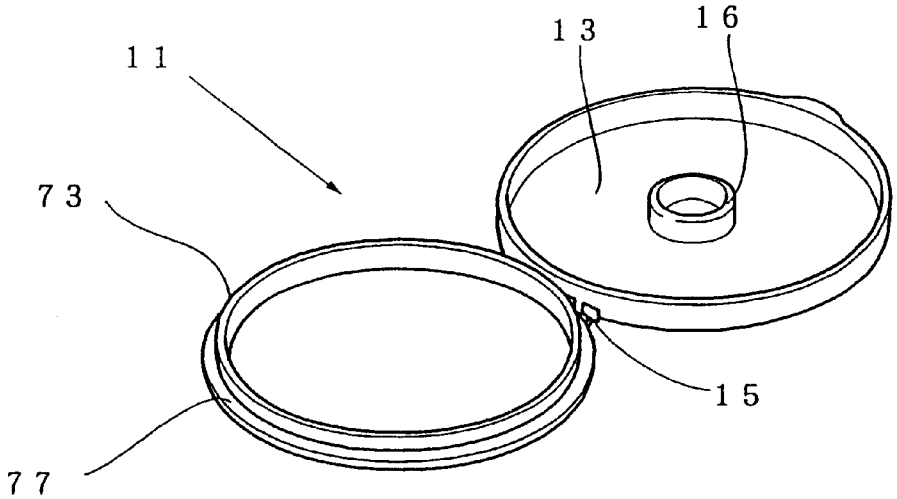
FIG. 36 is a perspective view of the container shown in FIG. 34 in a disassembled state.
Figure 36:
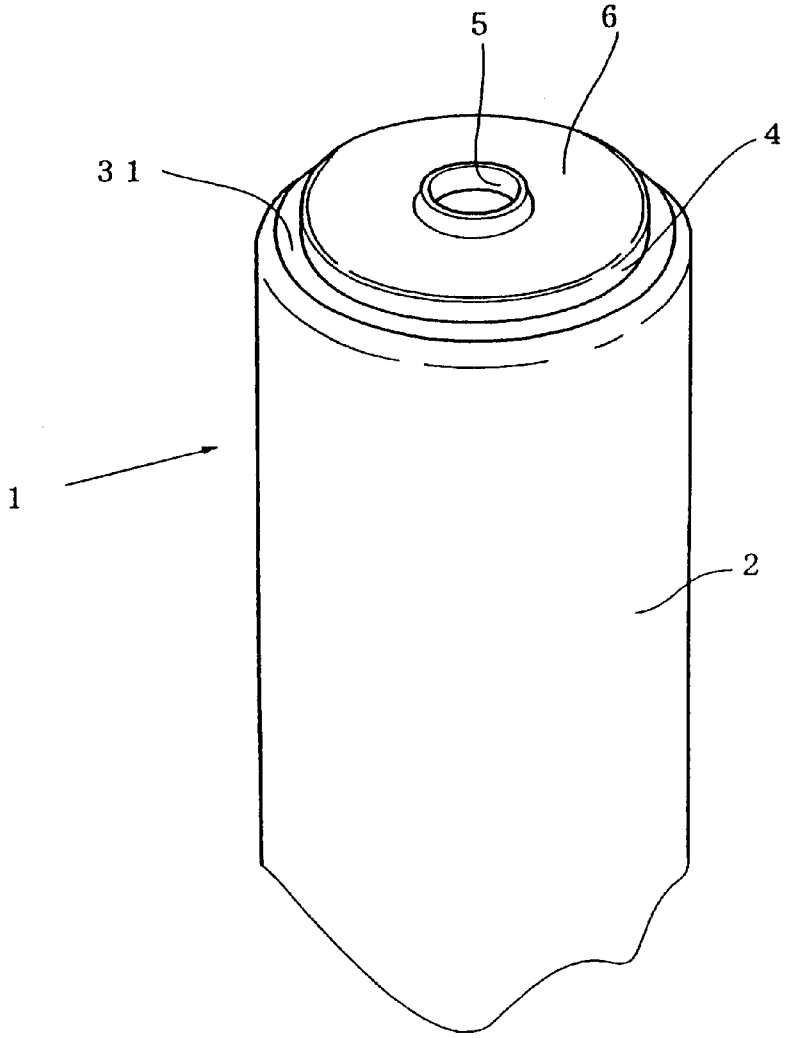

FIGS. 34 to 36 show a twelfth embodiment of the present invention.

In this embodiment, the fitting cylinder of the tenth embodiment is further shortened, and the lower portion of fitting cylinder is extended outwardly. The explanation on the construction which is the same to those of the tenth embodiment is omitted hereinafter.

According to this embodiment, a container body 1 has a trunk portion 2, from the upper end of which an extremely short neck portion 4 is erecting through a flat shoulder 31, and the upper surface of the neck portion 4 is closed by a top wall 6 with a discharge port 5. The length of the neck portion is so small that the top wall 6 and the shoulder 31 are generally formed into a flat plate. The container body may be formed by the aforementioned down-process method.

The cap body 11 has a fitting cylinder 73 which has a length equal to that of the neck portion and is fitted thereon, and an outwardly extended plate portion 77 protruding from the lower end of the fitting cylinder for resting on the shoulder 31. A depending cylinder 14 is depending shortly from the periphery of the cover plate 13 and connected to a part of the outwardly extended plate portion 77 through a hinge 15, such that the depending cylinder may be fitted on the fitting cylinder 73.

According to the aforementioned structure, as the lower end of the depending cylinder 14 is not fitted on the upper end surface of the fitting cylinder 73 as it is in the tenth embodiment, but it is placed on the outwardly extended plate portion 77 attached at the lower end of the fitting cylinder, such that the height from the upper end of the shoulder to the upper surface of the cover plate is made smaller by the length of the fitting cylinder portion except its lower end portion. This contributes, together with shortening the neck portion, to economize the material for forming the container.

FIGS. 37 to 42 show a thirteenth embodiment of the present invention.

In this embodiment, a plurality of breaking pieces are provided between the upper end of the fitting cylinder 73 and the lower end of the depending cylinder 14 disclosed in the tenth embodiment for ensuring a sealing function against an unauthorized opening, and also a cover plate is adapted to achieve an elastic turn over (snap action). The explanation on the elements which are the same to those of the present invention is omitted.

In accordance with this embodiment, a container body 1 has a trunk portion 2, from which a neck portion 4 is erecting through a diameter reducing portion 81, and the upper surface of the neck portion 4 is closed by a top wall 6 with a discharge port 5. As one of the preferred embodiment, the top wall 6 has a circumference (a circumferential top wall portion except its rear portion in the drawings) which is depressed shallowly to form an engagement step portion 82 for fixing the lower end of the depending cylinder 14. As a further preferred embodiment, the rear portion of the top wall is depressed deeper than the engagement step portion 82 to formed a subsided depression 83 opened backwards and upwards. The front surface of the subsided depression is formed into a vertical flat surface 82. A sixth engagement ridge 85 is formed circumferentially on the external surface of the neck portion 4 below the bottom surface of the subsided depression.

A cap body 11 has a fitting cylinder 73 which is fixed firmly on the external surface of the neck portion 4, and a cover plate 13 with a circumference from which a depending cylinder 14 is extending downwards, said depending cylinder being connected to the rear portion of the fitting cylinder through a thin hinge 15.

Figure 42:
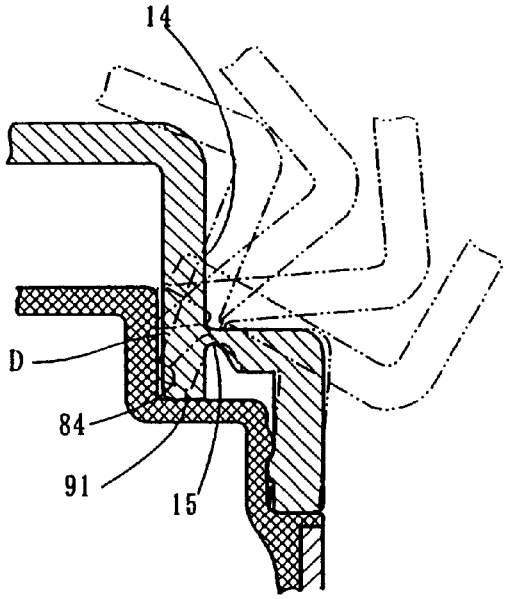
FIG. 42 is an enlarged view showing the center of the rotation of the cover plate shown in FIG. 41.
Figure 43:
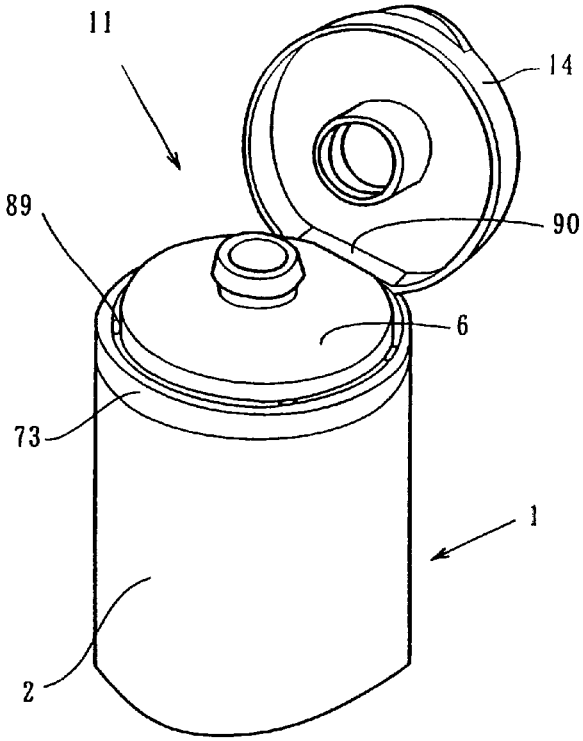
FIG. 43 is a perspective view of the container in a fourteenth embodiment of the present invention.
Figure 44:
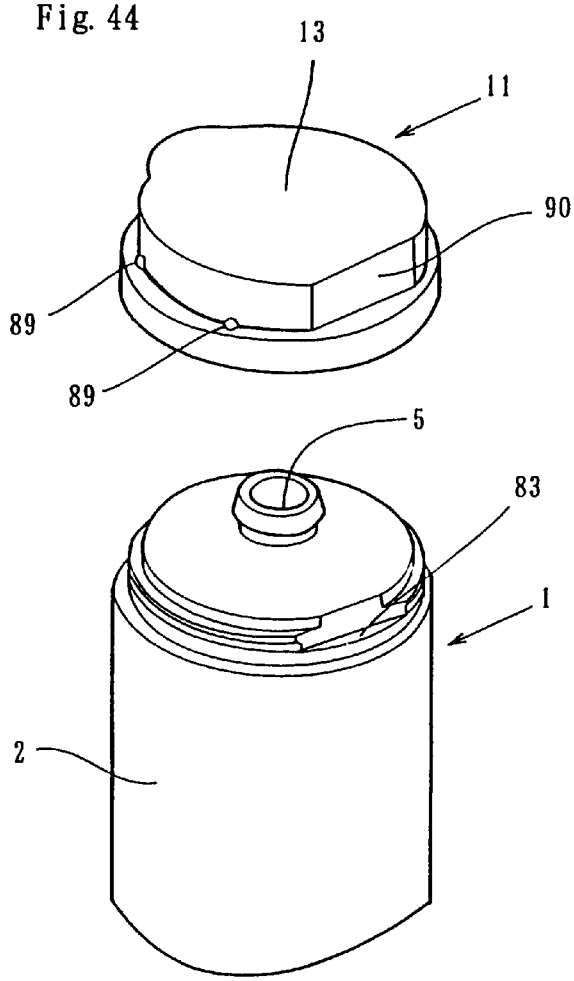
FIG. 44 is a perspective view of the container shown in FIG. 43 in a disassembled state.

The fitting cylinder 73 may preferably have a lower part in which a seventh engagement ridge 86 is formed circumferentially, such that the fitting cylinder is fixed firmly by engaging the seventh engagement ridge to the lower surface of the sixth engagement ridge. Also, as shown in FIG. 42, it is preferable that an inward extended wall 88 is protruding forward from the upper end of the rear wall of the fitting cylinder 73, leaving a space 87 between the the bottom surface of the subsided depression 83 and the inward extended wall itself. The leading end of the inward extended wall 88 is connected to the rear wall of the depending cylinder 14 through a thin hinge 15.

Figure 38:
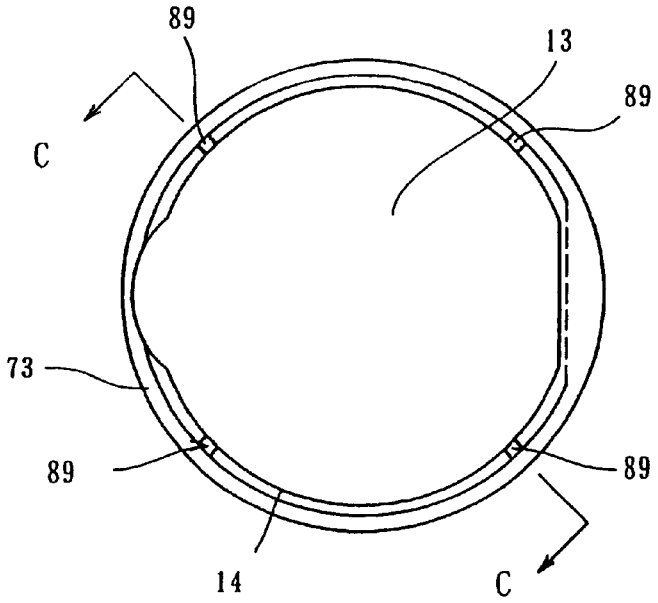
FIG. 38 is a top plan view of the container shown in FIG. 37.
Figure 39:
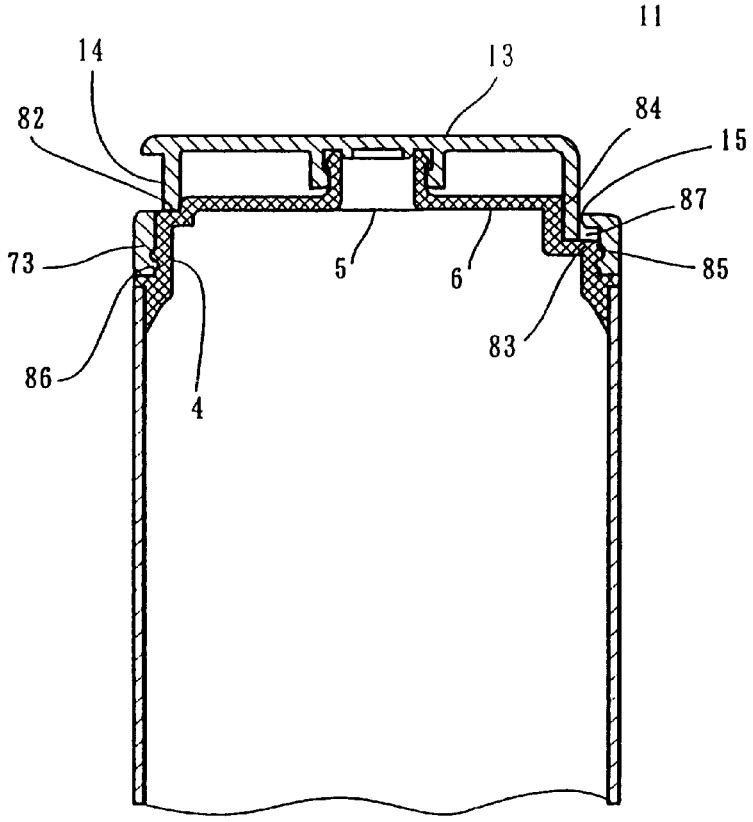
FIG. 39 is a vertical sectional side view of the container shown in FIG. 37.
Figure 40:
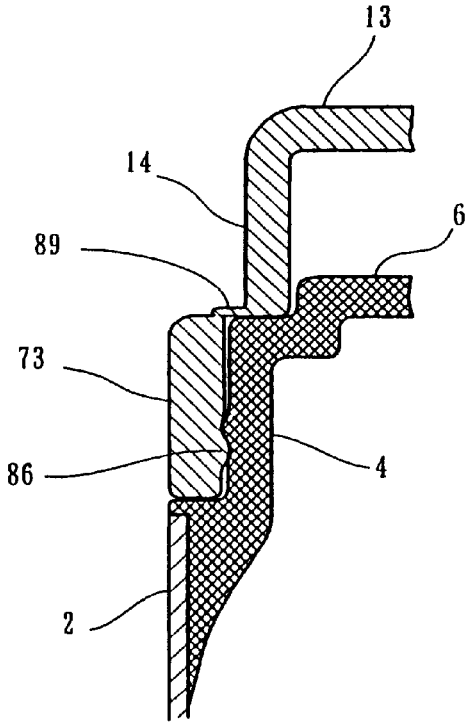
FIG. 40 is an enlarged view of an essential part of the container shown in FIG. 38 taken along a C—C line.
Figure 41:
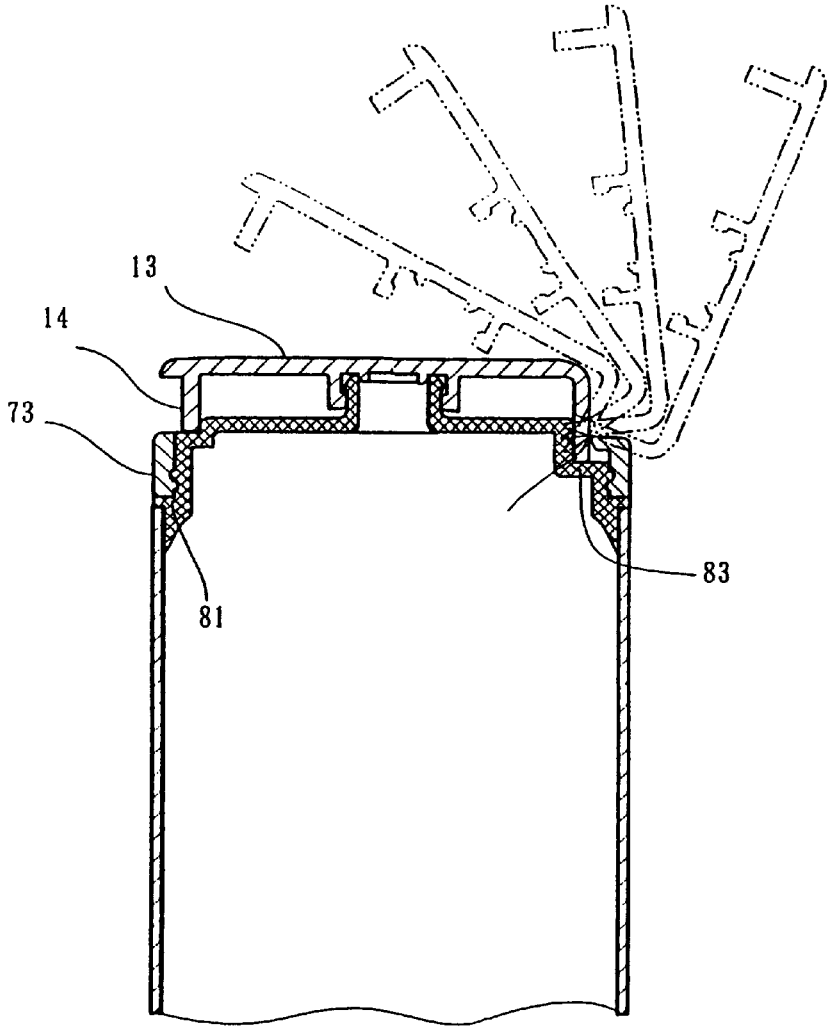
FIG. 41 is an explanation view of the rotation of the cover of the container shown in FIG. 37.

The depending cylinder 14 has a lower end portion which is connected to the upper end portion of the fitting cylinder 73 via a single or plurality of breaking pieces 89. It is preferable that the depending cylinder 14 and the fitting cylinder 73 are connected by the plurality of the breaking pieces spaced apart each other in a circumferential direction as shown in FIG. 38, for preventing these pieces from breaking accidentally by adding an incidental force to the depending cylinder 14 and the cover plate 13 when the container is fallen to a floor for example. Furthermore, the depending cylinder 14 may have an external diameter which is smaller than the inner diameter of the fitting cylinder as shown in FIG. 40, such that the lower end portion of the depending cylinder 14 is engaged to the engagement step portion 82 of the top wall, such that these breaking pieces are safe from unfavorable fracture due to the incidental force. As shown in drawings, the upper end of the fitting cylinder 73 is connected at its inner edge to the outer edge of the lower end of the depending cylinder 14 by the breaking pieces 89 extending through an interval therebetween.

The rear wall of the depending cylinder 14 is formed into a vertical wall portion 90 which is flatten in left and right direction as shown in FIG. 38. A leg portion 91 is extending downwards from the lower end of the vertical wall portion 90 and is contacting with the vertical surface 84 as shown in FIG. 42. Due to the contact, it is possible to locate the rear portion of the cap body 11 in a place corresponding to the rear part of the neck portion 4. This facilitates, for example, to print something on the trunk portion of the container body in a suitable place taking the orientation of the cap body in account. Meanwhile, the upper end of the leg portion is at its back surface connected to the leading end of the inward extended wall 88 through the hinge 15.

Figure 37:
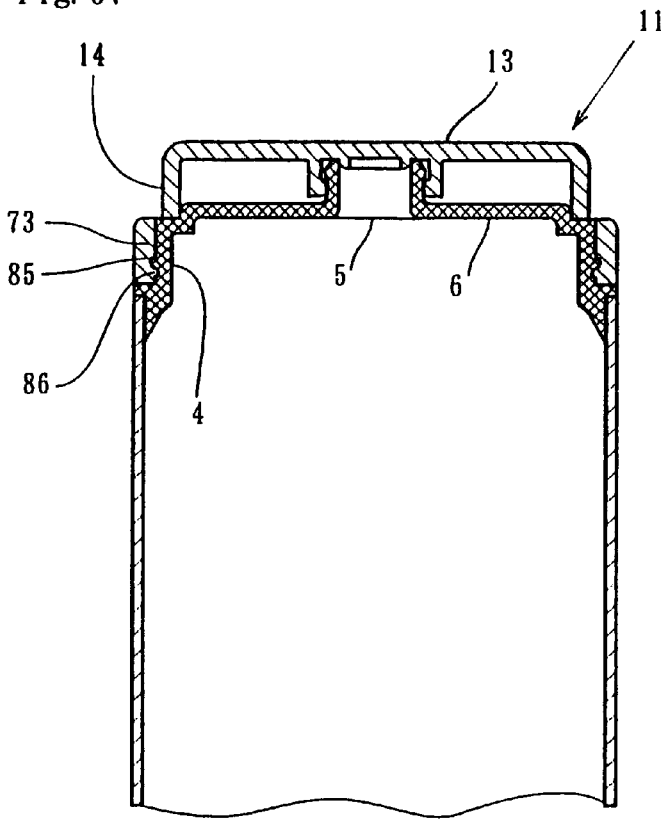
FIG. 37 is a vertical sectional view of the container in an thirteenth embodiment of the present invention.

In the above-mentioned construction, the breaking pieces 89 . . . prevent the unauthorized opening of the cover plate by by connecting the lower end of the depending cylinder 14 and the fitting cylinder 73, as shown in FIG. 37 and FIG. 38.

When the front portion of the cover plate 13 is pushed up by a finger of the user, the breaking pieces 89 . . . are broken. By pushing up the front portion of the cover plate further, the leg portion 91 turns around the thin hinge 15 while pressing against the vertical surface 84, as depicted in a double dot chain line shown in FIG. 42. And then, after riding over an equilibrium point D forcibly, the leg portion turns over to the upper side, such that the cover plate 13 elastically turns over into an open state. Next, when the cover plate in the open state is pushed into the closed state, the cover plate 13 turns over elastically in a reserved order and returns to the closed state in FIG. 37. FIGS. 43 to 46 show a fourteenth embodiment of the present invention.

Figure 45:
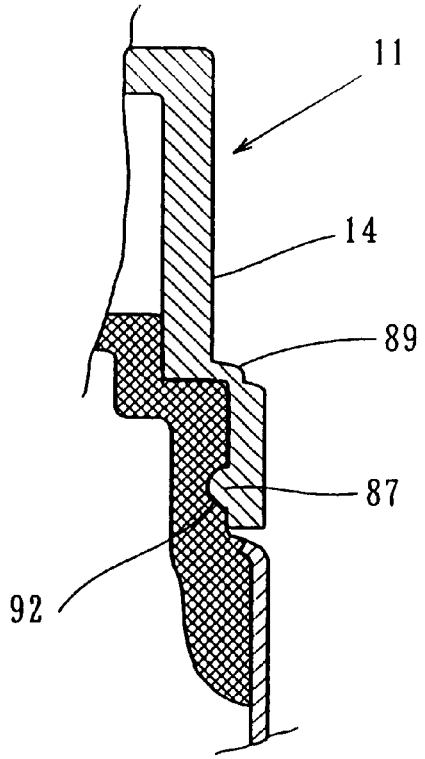
FIG. 45 is an enlarged view of an essential part of the container shown in FIG. 43 in one direction.
Figure 46:
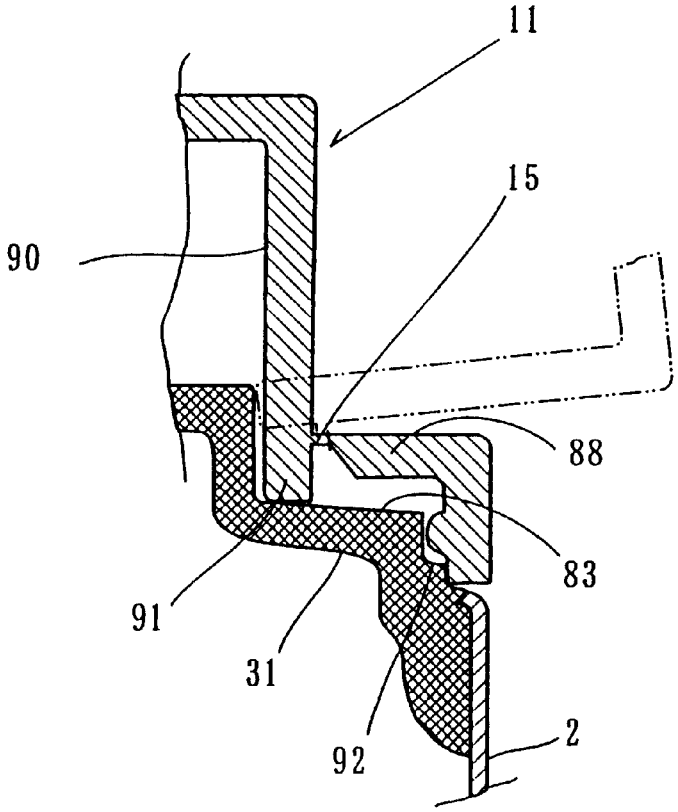
FIG. 46 is an enlarged view of an essential part of the container shown in FIG. 43 in another direction.
Figure 47:
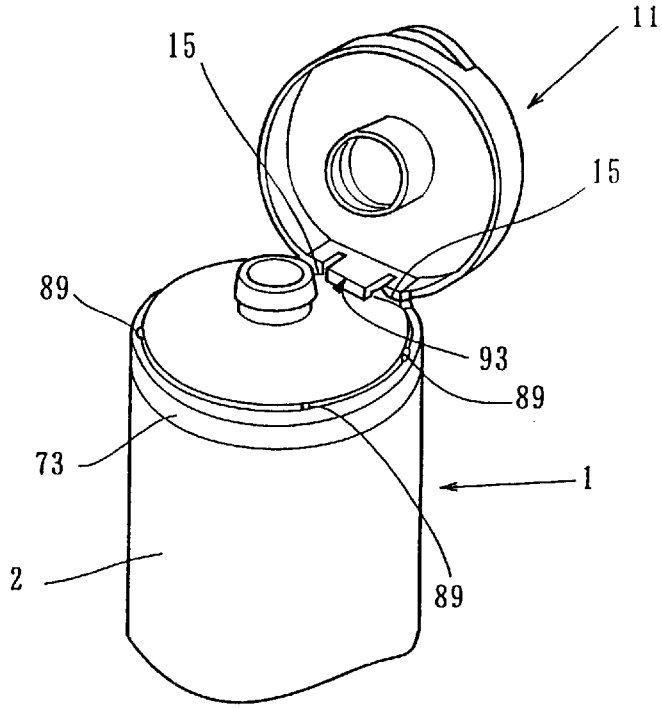
FIG. 47 is a perspective view of the container in a fifteenth embodiment of the present invention.

In this embodiment, it could be understood by comparing FIG. 42 and FIG. 46, the width of a subsided depression 83 in forward or backward direction is larger than that in the thirteenth embodiment, while the extended length of the inward extended wall 88 is made larger corresponding to the enlarged width of the subsided depression. Due to this feature, it is possible to increase an allowance for elastic deformation of the inward extended wall 88, the vertical wall portion 90 and the leg portion 91, so as to lessen stress applied to the hinge 15. Moreover, the lower portion of the neck portion 4 is preferably provided at its outer surface with an engagement groove 92 for fitting the seventh engagement ridge 86 firmly as shown in FIG. 45, instead of the sixth engagement ridge 85. The upper surface of the engagement groove 92 is opened to the bottom of the subsided depression 83 in the back of the neck portion 4 as shown in FIG. 46.

FIGS. 47 to 50 show a fifteenth embodiment of the present invention.

Figure 48:
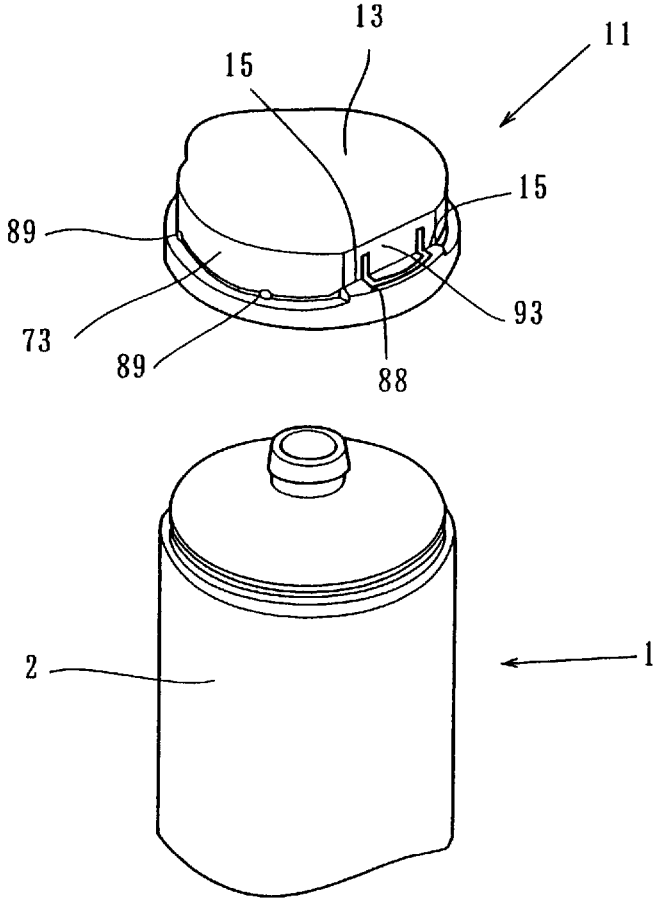
FIG. 48 is a perspective view of the container shown in FIG. 47 in a disassembled state.
Figure 49:
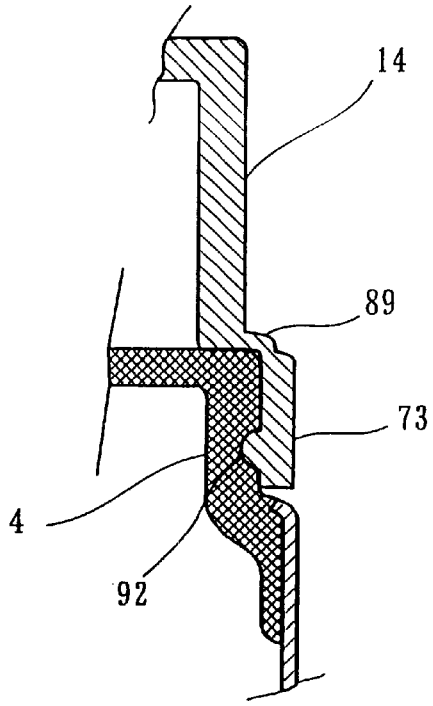
FIG. 49 is an enlarged view of a junction connecting the container body of FIG. 47 to its cap body.

This embodiment is different from the fourteenth embodiment in that the leg portion 91 is removed from the vertical wall portion 90 of the fourteenth embodiment, and that an inward extended wall 88 is protruding forwards from the rear portion of the fitting cylinder 73 and resting on the the top wall 6, while the leading end of the inward extended wall 88 is jointed to the lower end of the vertical wall portion. The joint between the two walls has left and right portions, which are formed into a pair of thin hinges 15,15, between which an elastic plate 93 having a L-shaped vertical section is formed as shown in FIG. 48. The elastic plate is made of a widthwise intermediate wall portion which is located between the hinges and ranging from the lower half of the vertical wall portion 90 and the front half of the inward extended wall 88, said widthwise wall portion is encircled by a notch except the upper end of the wall portion itself.

Figure 50:
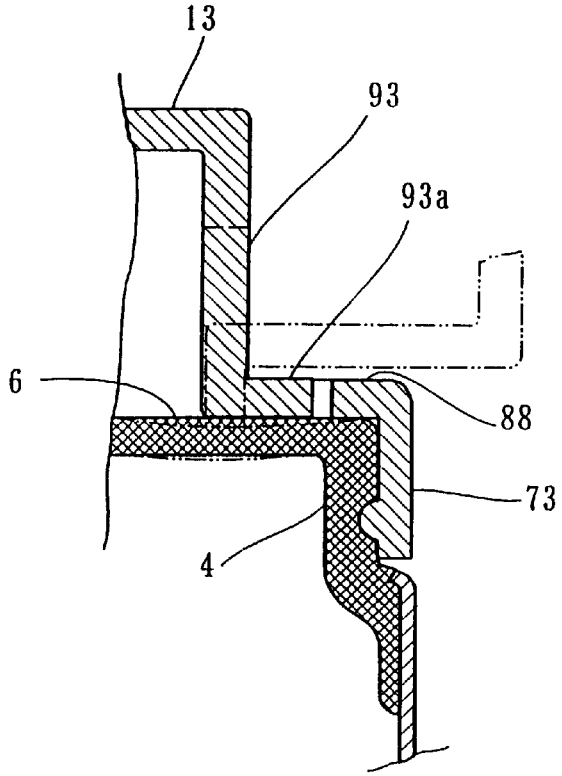
FIG. 50 is an enlarged view of another junction connecting the container body of FIG. 47 to its cap body.
Figure 51:
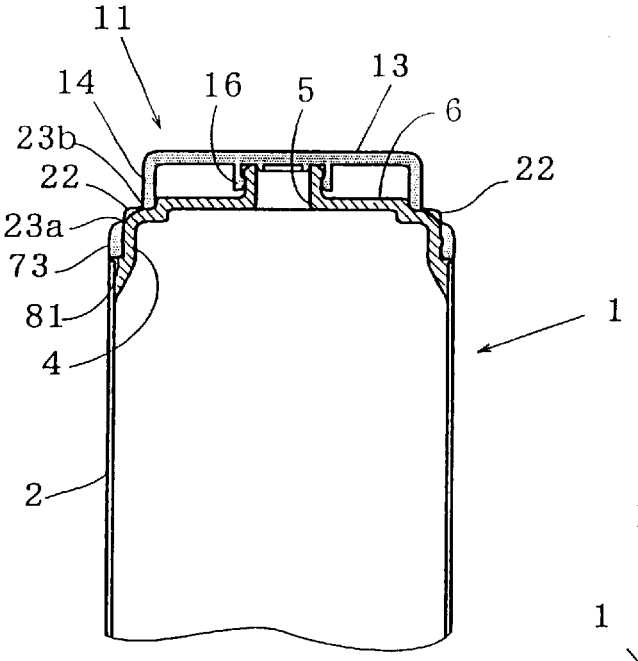
FIG. 51 is a front vertical section of the container in a sixteenth embodiment of the present invention.
Figure 52:
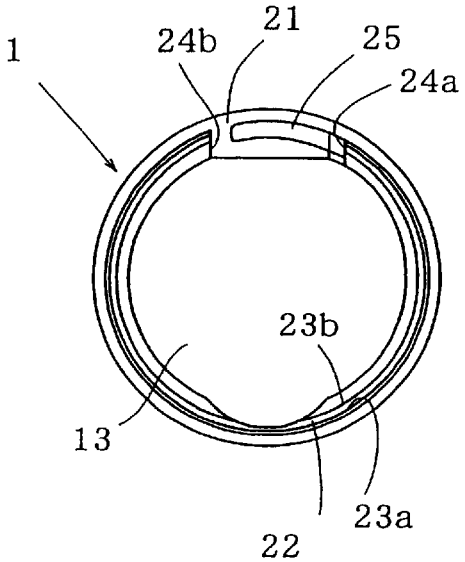
FIG. 52 is a top plan view of the container shown in FIG. 51.
Figure 53:
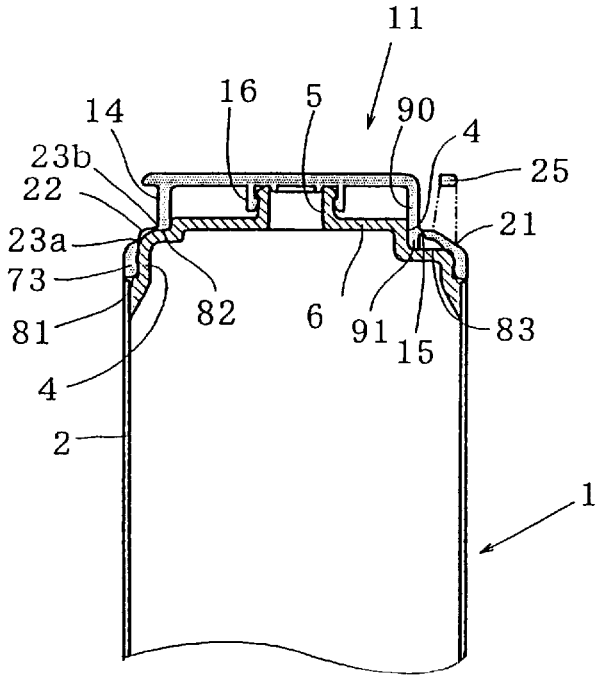
FIG. 53 is a vertical sectional side view of the container shown in FIG. 51.
Figure 54:
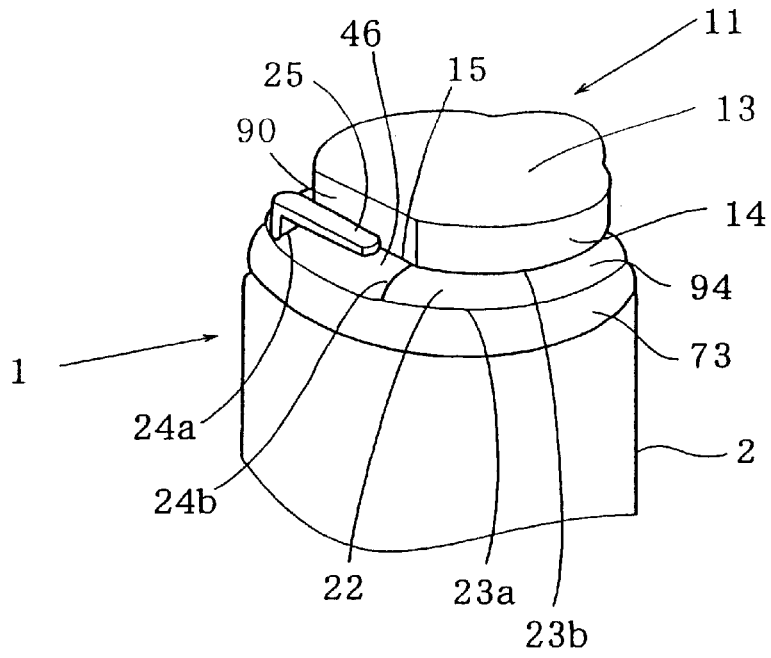
FIG. 54 is a perspective view of the container shown in FIG. 51.
Figure 55:
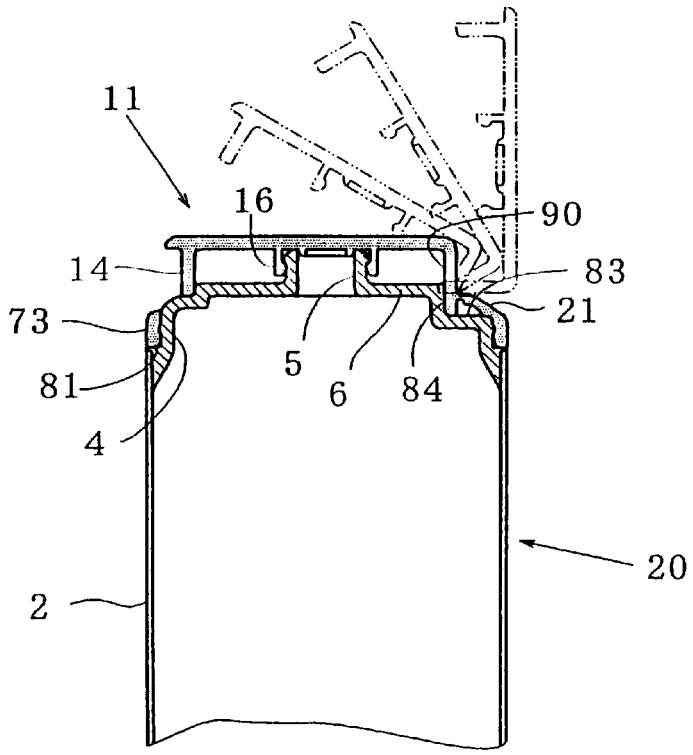
FIG. 55 is an explanation view of the container of FIG. 51 in an open state after the removable belt is removed.
Figure 56:
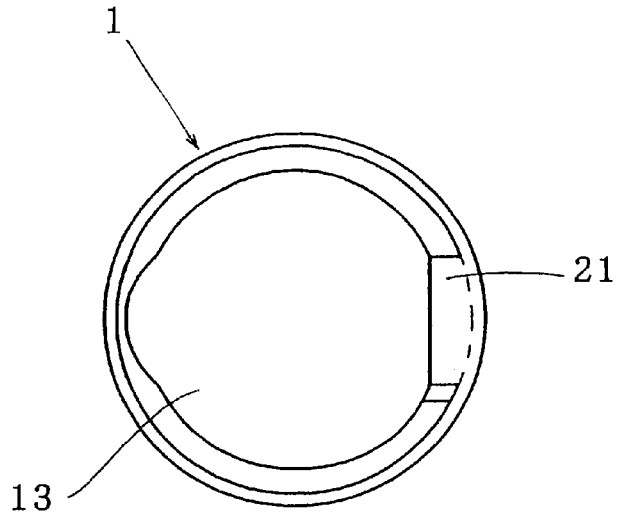
FIG. 56 is a top view after the removable belt is removed.

In the above-mentioned construction, when the front of the cover plate 13 is pushed up from the state shown in FIG. 50, the plurality of breaking pieces 89 . . . are broken, and thereafter the L-shaped elastic plate 93 has its horizontal wall portion 93*a* pressed against the upper side of the top wall 6. Then the horizontal wall portion is riding over an equilibrium point (not shown) forcibly and turned over into a vertical state, such that the cap body 11 is also turned over elastically into an opened state. By turning the cap body from the open state to a closed state, the cover plate is turned over again, returning to the state in FIG. 50.

FIGS. 51 to 58 show a sixteenth embodiment of the present invention.

In this embodiment, in stead of the breaking pieces in the thirteenth embodiment, a removable belt is formed between the upper end of a fitting cylinder and the lower end of a depending cylinder. The explanation on the elements which are the same to those in the thirteenth embodiment may be omitted.

Also in accordance with this embodiment, a container body 1 has a trunk portion 2 with an upper end from which a neck portion 4 is erecting through a diameter reducing portion 81, and the upper surface of the neck portion 4 is closed by a top wall 6 with a discharge port 5. An engagement step portion 82 may be formed at the periphery of the top wall 6 as it is in the thirteenth embodiment, and the rear portion of the top wall may be depressed deeper than the engagement step portion to form into a subsided depression 83.

Figure 57:
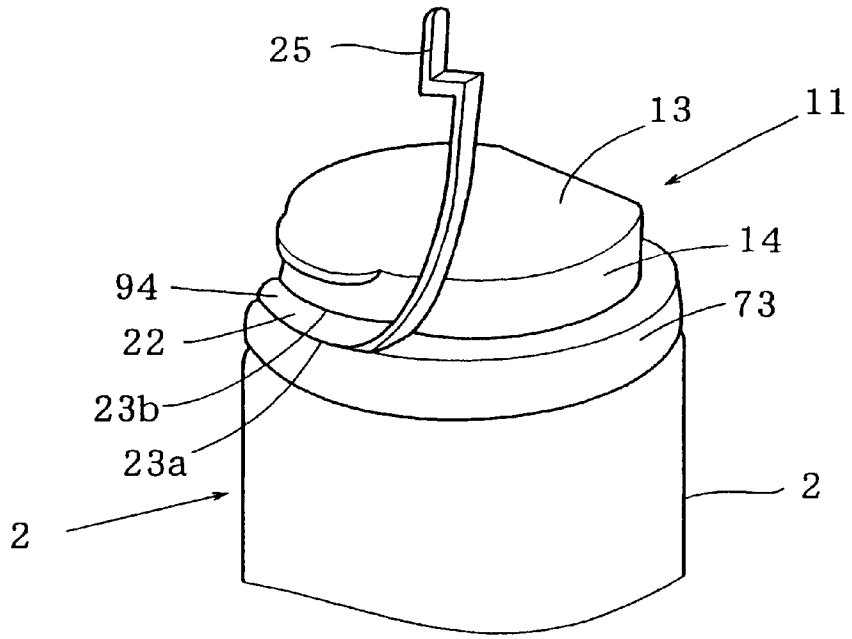
FIG. 57 is a perspective view of the container shown in FIG. 57 when the removable belt is removing.
Figure 58:
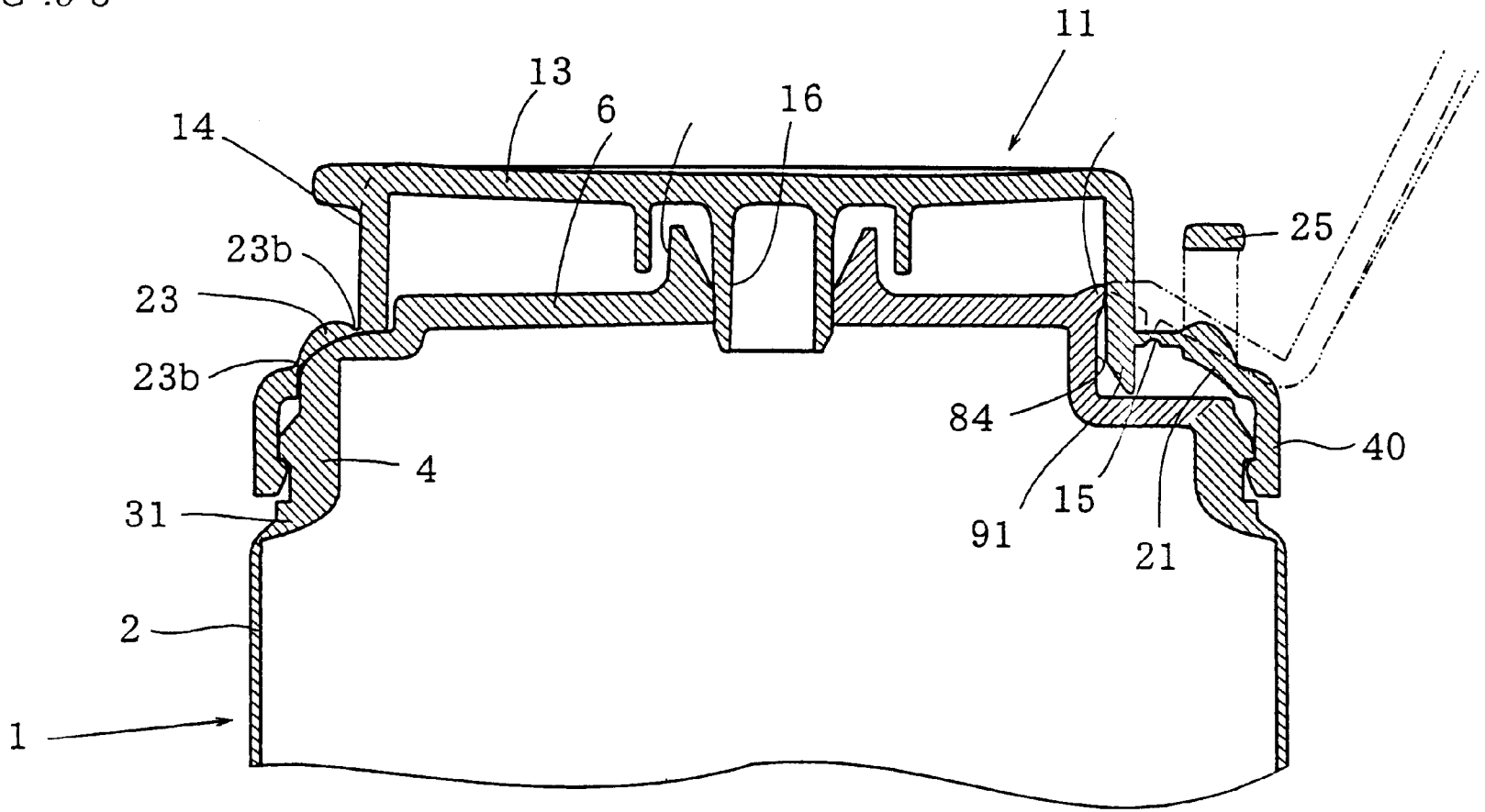
FIG. 58 is a vertical sectional side view of an essential portion of the container shown in FIG. 51.

A cap body 11 has a fitting cylinder 73 rested on the diameter reducing portion 81 and fitted firmly on the external surface of the neck portion 4. A flanged wall 94 is protruding inwards from the upper end of the fitting cylinder 73, and has an inner edge connected to the lower end of the depending cylinder 14. In the shown embodiment, the flanged wall is generally inclined to inwardly upwards in conformity with a curvature on a juncture between the neck portion 4 and the top wall 6. The flanged wall has a rear portion which is formed into a hinge portion 21, and also a remainder thereof which is formed into a removable belt 22 by enclosing it with a breaking line. Namely, a pair of first breaking lines 23*a*, 23*b* are formed between the removable belt 22 and the fitting cylinder 73 or the depending cylinder 14, while a pair of second breaking lines 24*a*, 24*b* are formed between the removable belt 22 and the hinge portion 21 for connecting the first breaking lines. A L-shaped knob 25 is attached on the external surface of the removable belt 22 near in the vicinity of the one of the second breaking lines, such that the removable belt 22 may be removed as shown in FIG. 57 by pulling the knob.

The depending cylinder 14 has a rear wall which is formed into a vertical wall portion 90 contacting with a vertical surface 84 of the subsided depression 83, as it does in the thirteenth embodiment. A leg portion 91 is depending from the lower end of the vertical wall portion 90 and contacts with the vertical surface 84, such that the cover plate may be turned over elastically.

1 . . . container body
2 . . . trunk portion
2*a* . . . tapering cylinder
3 . . . inward flanged wall
4 . . . neck portion
4*a* . . . lower half portion
4*b* . . . upper half portion
5 . . . discharge port
6 . . . top wall
7 . . . fitting recessed groove
8 . . . outward flange
9 . . . mounting cylinder
9*a* . . . lower portion
9*b* . . . upper portion
11 . . . cap body
12 . . . insert cylinder
13 . . . cover plate
14 . . . depending cylinder
14*a* . . . lower cylindrical portion
14*b* . . . upper cylindrical portion
14*c* . . . intermediate cylindrical portion
15 . . . thin hinge
16 . . . plug
17 . . . anti-opening plate
18 . . . spring
21 . . . hinge portion
22 . . . removable belt
23 . . . first breaking line
24 . . . second breaking line
25 . . . knob
31 . . . shoulder
32 . . . clipping cylinder
33 . . . first engagement ridge
34 . . . second engagement ridge
35 . . . first rotation-resisting ridge
36 . . . notched groove
37 . . . ring-shaped basic portion
38 . . . fixing cylinder
39 . . . third engagement ridge
40 . . . fourth engagement ridge
41 . . . second rotation-resisting ridge
42 . . . rib
43 . . . slant wall
44 . . . angular portion
45 . . . double cylinder
51 . . . head portion
52 . . . deep groove
53 . . . rear wall
54 . . . engagement hole
55 . . . fitting recess
56 . . . hinge mechanism
56*a* . . . first hinge
56*b* . . . second hinge
57 . . . insert plate
58 . . . elastic plate
59 . . . engagement projection
60 . . . engagement hole
61 . . . notch
71 . . . large external diameter portion
72 . . . vertical groove
72*a* . . . bottom surface
73 . . . fitting cylinder
74 . . . fifth engagement ridge
75 . . . vertical ridge
77 . . . outwardly extended plate
81 . . . diameter reducing portion
82 . . . engagement step portion
83 . . . subsided depression
84 . . . vertical surface
85 . . . sixth engagement ridge
86 . . . seventh engagement ridge
87 . . . space
88 . . . inward extended wall
89 . . . breaking piece
90 . . . vertical wall portion
91 . . . leg portion
92 . . . engagement groove
93 . . . elastic plate
93*a* . . . horizontal plate portion
94 . . . flanged wall

What is claimed is:

1. A synthetic resin made tube container comprising:

a container body having a trunk portion, which is elastically squeezable, and a neck portion extending upwardly from the trunk portion through an inward flanged wall, on which a fitting recessed groove having an upper open surface is formed circumferentially, and a top wall for closing an upper surface of the neck portion and having a discharge port, a cap body having an insert cylinder for being inserted into the fitting recessed groove, and a cover plate which is connected to the insert cylinder through a hinge and has a plug depending from a lower face of the cover plate for closing the discharge port, wherein said container body further has a mounting cylinder fitted into an upper portion of the trunk portion, said mounting cylinder having a lower part from which the neck portion is extending upwardly through the inward flanged wall, such that the fitting recessed groove is formed between an inside of the mounting cylinder and an outside of the neck portion.

2. A synthetic resin made tube container according to claim 1, wherein said cap body has a depending cylinder which is extending downwardly from a circumference of the cover plate for resting on the insert cylinder, and connected to the insert cylinder through the hinge.

3. A synthetic resin made tube container according to claim 2, an anti-opening plate is depending from an outside of the depending cylinder, and attached to an outer surface of the trunk portion, forcibly removable therefrom.

4. A synthetic resin made tube container comprising:

a container body having a trunk portion which is elastically squeezable, and a neck portion extending upwardly from the trunk portion through an inward flanged wall, on which a fitting recessed groove having an upwardly opened surface is formed circumferentially, and a top wall for closing an upper surface of the neck portion and having a discharge port, a cap body having a cover plate with an outer circumference, from which a depending cylinder is extending downwardly, said depending cylinder having a lower cylindrical portion, an upper cylindrical portion, and an intermediate cylindrical portion therebetween, said lower cylindrical portion being adapted to be inserted and fitted into the fitting recessed groove, and the intermediate cylindrical portion having a part to be formed into a hinge, while a remainder of the intermediate cylindrical portion being surrounded by a breaking line and formed into a removable belt which has a knob that the upper cylindrical portion and the cover plate are formed into a lid.

5. A synthetic resin made tube container comprising:

a container body having a trunk portion which is elastically squeezable, and a short neck portion extending upwardly from the trunk portion through a shoulder, a cap body having a ring-shaped base portion, and a cover plate with a circumference from which a depending cylinder is extending downwardly, a lower portion of the depending cylinder being connected to a part of the ring-shaped base portion through a hinge, wherein a fitting recessed groove is formed on either one of the ring-shaped base portion and the neck portion, while an insert cylinder is formed on the other of the ring-shaped base portion and the neck portion, such that the ring-shaped base portion is connected to the neck portion by fitting the insert cylinder into the fitting recessed groove, and whereby an upper surface of the ring-shaped base portion is closed by a top wall with a discharge port, and a plug for closing the discharge port is depending from a lower side of the cover plate, while said cover plate and the depending cylinder are connected by a slant wall, said slant wall is formed over the hinge to decline obliquely downwards for preventing the cap body from hitting against the shoulder when the cover plate is opened.

6. A synthetic resin made tube container comprising:

a container body having a trunk portion which is elastically squeezable, a short neck portion extending upwardly from the trunk portion, and a top wall closing a top surface of the neck portion and having a discharge port, a periphery of said top wall being integrally connected to an upper end of said neck portion, a cap body having a fitting cylinder which is undetachably fitted onto the neck portion, and a cover plate which is attached to the fitting cylinder through a hinge, and a plug which is depending from a lower side of the cover plate for fitting into the discharge port.

7. A synthetic resin made tube container according to claim 6, wherein the neck portion has an upper portion which is formed into a large external diameter portion having a vertical groove, while the fitting cylinder has an inner surface at a lower part of which an engagement ridge is circumferentially formed for providing an engagement with an underside of the large external diameter portion, and also a vertical ridge for fitting into the vertical groove is formed in the inner surface of the fitting cylinder so as to prevent the fitting cylinder from turning into a circumferential direction.

8. A synthetic resin made tube container according to claim;

wherein the container body also has a flat shoulder through which the neck portion is extending upwardly from the trunk portion, while an outwardly extended plate for resting on the flat shoulder is circumferentially formed at a lower end of the fitting cylinder which is fixed on the neck portion, whereby a depending cylinder is extending downwardly from a circumference of the cover plate, and connected to a portion of said outwardly extended plate through the hinge, said depending cylinder has a lower end portion which is fitted on an outside of said fitting cylinder.

9. A synthetic resin made tube container according to claim 6, wherein a depending cylinder, extending downwards from a circumference of the cover plate, has an external diameter smaller than an inner diameter of the fitting cylinder fitted on the neck portion, and that said depending cylinder further contains a lower end portion which rests on the periphery of the top wall leaving a small constant interval from a top end portion of the fitting cylinder and is connected to the top end portion by a single or plurality of breaking pieces, while a lower part of the depending cylinder is connected to the fitting cylinder through the hinge, on which the cover plate is able to turn so as to break the breaking pieces.

10. A synthetic resin made tube container according to claim 6, wherein a depending cylinder, extending downwards from a circumference of the cover plate, has an external diameter smaller than an inner diameter of the fitting cylinder fitted on the neck portion, and that said depending cylinder further contains a lower end portion which rests on the periphery of the top wall leaving a small constant interval from a top end portion of the fitting cylinder, said top end portion is formed continuously with the lower end portion of the depending cylinder through a flanged wall, a portion of which is formed into the hinge, while a remainder of the flanged wall is formed into a removable belt, a pair of first breaking lines are formed between the removable belt and the fitting cylinder, and between the removable belt and the depending cylinder, and also a pair of second breaking lines for connecting the first breaking lines are formed at a pair of circumferentially opposed end portions of the removable belt, while a knob is provided on an external surface of the removable belt in a vicinity of one of the second breaking lines.

* * * * *